United States Patent [19]

Dabiri et al.

[11] Patent Number: 5,037,602

[45] Date of Patent: Aug. 6, 1991

[54] RADIOISOTOPE PRODUCTION FACILITY FOR USE WITH POSITRON EMISSION TOMOGRAPHY

[75] Inventors: Ali E. Dabiri, San Diego; William K. Hagan, Encinitas, both of Calif.

[73] Assignee: Science Applications International Corporation, San Diego, Calif.

[21] Appl. No.: 323,563

[22] Filed: Mar. 14, 1989

[51] Int. Cl.[5] ..... G21G 1/10

[52] U.S. Cl. ..... 376/198; 376/196; 376/197; 376/190

[58] Field of Search ..... 376/196, 197, 198, 190

[56] References Cited

U.S. PATENT DOCUMENTS

| | | | |
|---|---|---|---|
| H. 75 | 6/1986 | Grisham et al. | 376/143 |
| 4,201,625 | 5/1980 | Erdtmann et al. | 176/11 |
| 4,812,775 | 3/1989 | Klinkowstein et al. | 328/233 |
| 4,888,532 | 5/1978 | Blue | 176/11 |

OTHER PUBLICATIONS

"Production of C . . . Graatt Accelerator", Internation Journal Applied Radiation & Isotopes, 1972, vol. 23, pp. 344-345.

"An Optimized Design for Pigmi", IEEE Transactions on Nuclear Science, vol. NS-28, No. 2, Apr. 1981, pp. 1511-1514.

"The Radio-Frequency Quadrupole Linear Accelerator", IEEE Transactions on Nuclear Science, vol. NS-28, No. 2, Aug. 1981.

"Production of . . . Anionic Contaminants", Appl. Radiat. Isot., vol. 39, No. 10, pp. 1065-1071, 1988.

"Production of Radio Nuclides and Labelled . . . from Accelerators", International Journal of Appl. Radiat. Isot., 1975, vol. 26, pp. 763-770.

"Zymate Laboratory Automation System", 12 page brochure (Zymark Corporation, Hopkinton, MA 1987).

Hamm, et al., "AA Compact Proton Linac for Positron Tomography", Proc. 1986, Linear Accelerator Conf., Stanford University, SLAC Report 303, pp. 141-143 (Palo Alto, CA 1986).

Stokes, et al., "The Radio-Frequency Quadrupole-A New Linear Accelerator", Proc. of the 1981 Linear Accelerator Conf., IEEE Trans. Nuclear Science NS-29, 1999 (1981).

*Primary Examiner*—Stephen J. Lechert, Jr.
*Assistant Examiner*—Nina Bhat
*Attorney, Agent, or Firm*—Fitch, Even, Tabin & Flannery

[57] ABSTRACT

A radioisotope production facility (12) produces radioisotopes having application to Positron Emission Tomography. The radioisotopes produced include $^{18}F$, $^{13}N$, $^{15}O$, and $^{11}C$, and are produced by irradiating a selected target material (40) with a high energy $^{3}He^{++}$ beam accelerated in a radio frequency quadruple (RFQ) linear accelerator (34). The facility includes, in addition to the RFQ linear accelerator and the selected target, a source of $^{3}He^{++}$ ions (30), low energy transport means (32) for focusing the $^{3}He^{++}$ beam into the RFQ linear accelerator, and a high energy transport means (36) for directing the accelerated $^{3}He^{++}$ beam at the selected target. Further included is a target subsystem (16) that holds the target, automatically prepares precursors containing the $^{18}F$, $^{13}N$, $^{15}O$, and $^{11}C$ radioisotopes, and an automated radiopharmaceutical subsystem (22) that prepares suitable radiopharmaceuticals from the desired precursors.

14 Claims, 10 Drawing Sheets

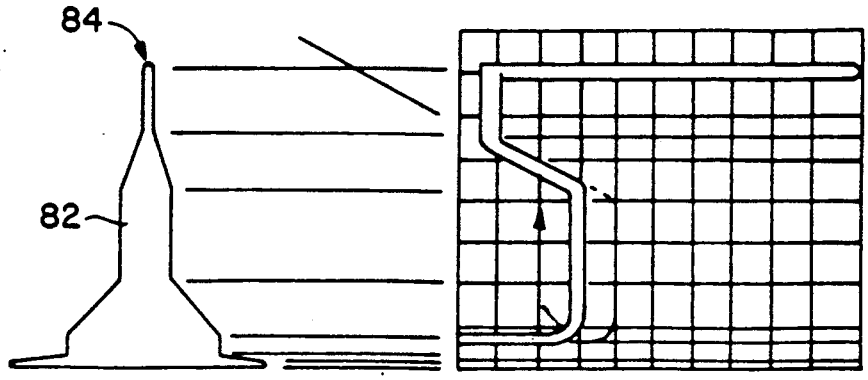
FIG. 5A
FIG. 4A
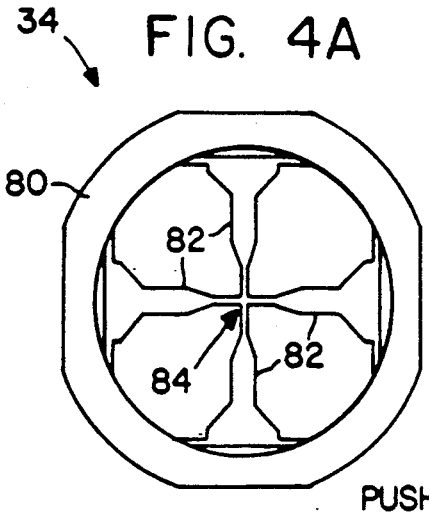
FIG. 4B
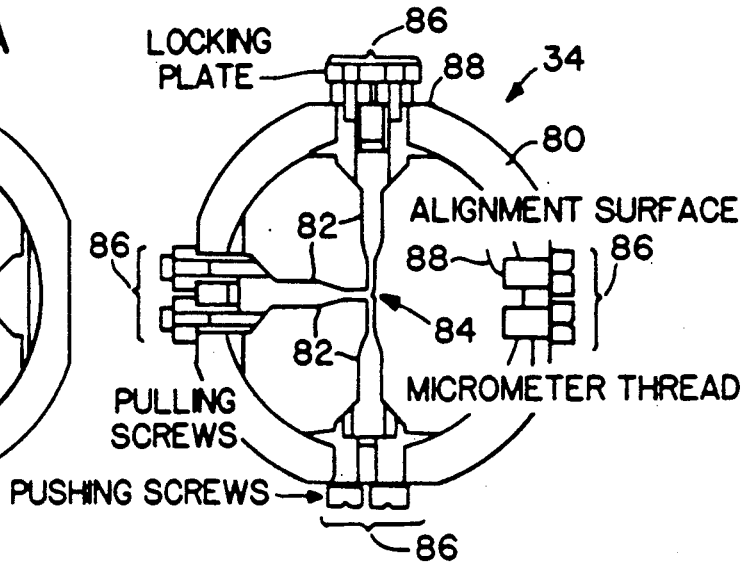

RADIOISOTOPE PRODUCTION FACILITY FOR USE WITH POSITRON EMISSION TOMOGRAPHY

The present invention relates to a facility and method for producing radioisotopes having application to Positron Emission Tomography ("PET"). More particularly, the present invention relates to a system utilizing a relatively small, light-weight Radio Frequency Quadrupole ("RFQ") accelerator for accelerating a beam of $^{3}He^{++}$ ions to an energy level sufficient to produce desired radionuclides when a selected target material is bombarded with the accelerated beam.

BACKGROUND OF THE INVENTION

PET is a nuclear medicine procedure for imaging and measuring physiologic processes within the body. It depends upon the distribution into the body of a systematically administered radiopharmaceutical labeled with a radioactive isotope ("radioisotope") that decays through the emission of positrons. This is very distinct from other nuclear imaging techniques such as Computed Tomography ("CT") which measures the distribution of electron density, or Magnetic Resonance Imaging ("MRI") which measures the distribution of protons in the body. There are literally hundreds of possible radiopharmaceuticals that find application to neurology, oncology, and cardiology. PET is typically directed to the study of metabolism processes, blood flow, blood pooling, and receptor sites in the brain.

In accordance with PET practice, a radiopharmaceutical (sometimes termed the "labeled compound") is injected into or inhaled by a patient after he or she has been positioned properly relative to an adjacent scanner device. It is the function of the scanner device to detect the gamma-rays that are produced when positrons emitted from the radioisotope annihilate with surrounding electrons. For example, a brain metabolism study might involve the injection of a fluorodeoxy-glucose radiopharmaceutical containing $^{18}F$ into the blood stream so that it is taken up in the brain at sites of metabolic activity. When an $^{18}F$ nucleus decays it emits a positron which, within a distance of a few millimeters, annihilates with an electron producing two oppositely directed 0.511 MeV gamma-rays. Crystal gamma-ray detectors in the scanner device surrounding the patient's head detect the arrival of the gamma-rays and identify the paths on which they traveled, defining the lines along which the annihilation events occurred. Time-of-flight techniques may also be used to locate the position of the events along the lines. Appropriate electronic circuits and a computer system(s) acquire data during the scan and map the distribution of the annihilation events, which coincide with the presence of the radioisotope. Quantitative evaluation of the function under study, as well as an image for display, are produced as a final product of the PET scan.

Radioisotopes are presently generated by accelerating protons to an energy of 12 MeV (or deuterons to an energy of 6 MeV) with a cyclotron. This proton/deuteron beam is extracted from the cyclotron and steered to a target material. Automatic chemical processors convert the target material into basic chemical building blocks, called "precursors", needed to make the radiopharmaceuticals of interest. Some state-of-the-art systems produce the final radiopharmaceutical with the aid of a programmed robot to avoid radiation exposure to a radiochemist. The PET scanner, which resembles a CT scanner in physical appearance, along with the cyclotron, targets, and chemical processors form the basic PET system.

Unfortunately, the half-life associated with many radioisotopes of interest to PET applications is very short (on the order of minutes), hence it is not possible to manufacture the radiopharmaceuticals at a manufacturing site and transport them to a patient location. Rather, the patient must travel to the site of the PET system where the needed radioisotopes can be produced and used immediately. Because of the sheer size, mass and expense of building and operating just the cyclotron (which is only one element of a PET system), there are relatively few PET facilities available throughout the world. (At present, it is estimated that there are only about 20 PET facilities in the United States, and about 60–70 worldwide.) Only the largest hospitals are able to afford, support and staff such systems. Thus, the benefits of PET remain available to relatively few. What is needed therefore is a PET system that is more affordable and accessible to a larger number of patients and doctors.

There are numerous disadvantages of existing low energy cyclotron-based PET systems. For example, some of the radionuclides are produced using a proton beam, while others are produced using a deuteron beam, therefore some beam switching apparatus is required. While such beam switching apparatus is well known in the art, it adds to the complexity and expense of the system. Further, large amounts of power are required for such systems to operate (e.g., the proton/deuteron cyclotron typically requires 100 kW of power to operate). Also, such systems require enriched target materials if the desired radionuclides are to be efficiently produced by the proton/deuteron beam. Such enriched target materials are not readily available, and are costly to produce. Still further, due to the inherent elliptical cross sectional shape of the proton/deuteron beam, the efficient utilization of the beam in a circular target chamber is made more difficult. Moreover, due to the secondary neutrons that are naturally produced from the proton/deuteron irradiation process, thick shields must be built around the target area to confine such neutron radiation. It is not uncommon, for example, for the target chamber of such systems to be surrounded by concrete walls that are a minimum of four feet thick. This shielding, coupled with the mass and weight associated with the other elements of the system, particularly the cyclotron, results in a system that weighs on the order of 300 tons. Such heavy systems can only be installed on a ground or basement floor, thereby severely restricting those facilities where a cyclotron-based PET system could be installed.

All of the above factors combine to make the proton/deuteron cyclotron-based PET systems very expensive to build, operate and maintain. As has been indicated, such expense disadvantageously limits the number of PET systems that are built and operated, thereby making the cyclotron-based PET systems generally inaccessible and/or unavailable to many patients, hospitals and doctors. What is needed, therefore, is a radioisotope production system which can produce sufficient quantities of all of the radioisotopes of interest ($^{18}F$, $^{11}C$, $^{15}O$, $^{13}N$) and minimize some or all of the disadvantages discussed above for existing systems. The present invention advantageously addresses this need.

SUMMARY OF THE INVENTION

The present invention is directed to a relatively inexpensive PET system that is easy to operate and maintain, and that produces all four of the radionuclides of interest to PET applications. Significantly, the system described herein does not require a cyclotron to generate a proton/deuteron beam. Rather, the PET system of the present invention makes use of a readily available ion source to produce a $^3He^{++}$ beam that is accelerated to around 8 MeV using a Radio Frequency Quadrupole ("RFQ") accelerator. This accelerated $^3He^{++}$ beam is then directed to a conventional, non-enriched target material(s) whereat the four primary radionuclides of interest to PET systems, $^{18}F$, $^{13}N$, $^{15}O$, and $^{11}C$, are efficiently produced. Advantageously, the RFQ accelerator is a small, light-weight device and requires significantly less operating power than does the cyclotron. The RFQ advantageously accelerates ions to a prescribed velocity. The RFQ is thus ideal for accelerating multiply charged ions with masses greater than a single proton mass. This characteristic of the RFQ, in combination with the benefits of using $^3He^{++}$, rather than protons or deuterons as described below, renders use of a $^3He$ RFQ as an advantageous and novel technique for producing radioisotopes for PET.

Further, the neutron-poor nature of the reaction resulting from a $^3He^{++}$ bombardment of the target material significantly reduces the amount of shielding that is required around the target chamber. Moreover, the generally circular cross section of the $^3He^{++}$ beam allows it to interact with the conventional circular cross-section target material in a more efficient manner than is possible with the elliptical cross-sectional shaped proton/deuteron beam of the cyclotron-based system of the prior art. The reduced shielding requirements, coupled with the small RFQ accelerator and the relatively low power requirements thereof, as well as the efficient use of the target material, makes possible a PET system that not only efficiently generates the needed radionuclides for PET applications, but that also is small, lightweight, affordable, and possibly transportable. Hence, the system can either be readily installed in or possibly transported to the hospitals and other medical facilities where it is needed, thereby making the benefits of PET available to a much larger segment of the world's population.

The present invention may thus be summarized as a system for producing radionuclides for use with PET is provided, the system including: a source of ions for producing a $^3He^{++}$ beam at a low energy; a radio frequency quadrupole (RFQ) accelerator for accelerating the low energy $^3He^{++}$ beam to a high energy, and a target system. The target system includes at least one target compound selected to produce at least one desired radionuclide when it is irradiated by the accelerated $^3He^{++}$. beam. This desired radionuclide(s) is then combined, in conventional manner, to produce appropriate precursors which can produce any one of the hundreds of possible radiopharmaceuticals that are used in PET or related applications.

Further, the present invention may be characterized as a radioisotope production facility for producing radioisotopes for use with PET. Such a facility includes: RFQ accelerator means for producing a high energy beam of $^3He^{++}$ ions; and means for irradiating a selected target material with the high energy $^3He^{++}$ beam; the target material being selected to produce at least one desired radioisotope when irradiated by the high energy $^3He^{++}$ beam.

Still further, the present invention encompasses a method for producing a radiopharmaceutical suitable for use with a PET system. This method comprises the steps of: (a) accelerating a beam of $^3He^{++}$ ions using a RFQ accelerator to a high energy level, e.g., at least 8 MeV; (b) irradiating a target compound with the accelerated $^3He^{++}$ beam to produce at least one desired radionuclide; (c) processing the radionuclide obtained in step (b) to produce a desired precursor containing the radionuclide; and (d) preparing a suitable radiopharmaceutical from the precursor.

It is a feature of the present invention to provide a PET system that is small and light weight, thereby allowing the system to be transportable.

Another feature of the present invention is to provide such a system that operates on roughly 1/5 of the operating power required by the cyclotron-based PET systems of the prior art.

A further feature of the invention is to provide a PET system that occupies only about $\frac{1}{3}$ of the floor space that is occupied by the cyclotron-based PET systems of the prior art, and that weighs only about 1/10 of what such prior art cyclotron-based systems typically weigh.

Yet another feature of the invention is that the single beam used therein, can be readily and inexpensively generated from a commercial source of ions.

A further feature of the invention provides a system as above-described that is very simple to operate, typically requiring the operation of only a few push-buttons, thereby requiring minimal training for its operation. This feature is important because a major part of the cost of the current cyclotron-based PET systems is the cost of the staff. When technicians instead of accelerator experts and radiochemists are used to operate the system, a substantial saving in operating costs results.

Another feature of the invention contributing to its simplicity is the lack of a beam extraction system. That is, no extraction system is required to extract the $^3He^{++}$ beam from the RFQ accelerator as is required to extract a proton/deuteron beam from a cyclotron.

Still another feature of the invention allows the presently available and medically-proven and accepted target systems, including the programmable robotic features thereof, e.g., those used in existing cyclotron-based PET systems, to be used therewith. Significantly, however, due to the neutron-poor nature of the $^3He^{++}$ beam and resulting reactions, no shielding around the accelerator and little shielding around the target chambers is required relative to existing cyclotron-based PET systems.

BRIEF DESCRIPTION OF THE DRAWINGS

The above and other features and advantages of the present invention will be more apparent from the following more particular description thereof, presented in conjunction with the following drawings and appendix wherein:

FIG. 4A shows a cross-sectional view of the RFQ accelerator;

FIG. 4B illustrates the alignment features of the RFQ accelerator;

FIG. 5A shows a sketch of the vane termination profile and cross section of the RFQ accelerator;

Appendix A contains a brief description of the target and precursor system.

Appendix B contains a description of a commercially available RFQ accelerator that may be incorporated into the radioisotope production facility of the present invention.

DETAILED DESCRIPTION OF THE INVENTION

The following description is of the best presently contemplated mode of carrying out the invention. This description is not to be taken in a limiting sense, but is made merely for the purpose of describing the general principles of the invention. The scope of the invention should be determined with reference to the appended claims.

In making reference to the drawings, like numerals will be used to refer to like parts throughout.

At the outset, it is noted that the following detailed description is based on an RFQ accelerator which is commercially available from Science Applications International Corporation of San Diego, Calif. A good description of this RFQ may be found in Appendix B. submitted herewith. Appendix B comprises a paper presented at The First European Accelerator Technology Conference, held in Rome, Italy, in June of 1988. The paper is entitled "A Compact 1 MeV Deuteron RFQ Linac." The authors of the paper are D. A. Swenson and P. E. Young. Further, the target system is based on the eight position target handling system which is commercially available from Scanditronix of Uppsala, Sweden. Some information relative to the target system is provided in Appendix A. It is noted that the information presented in Appendix A does not necessarily relate to the Scanditronix-based target system. Rather, much of the information is background information related to target systems in general. At least some portions of Appendix A, e.g., describing the "windowless target system" present a novel approach, never before utilized (to Applicants' knowledge), that offers significant advantages over other types of target systems.

Figure 1:
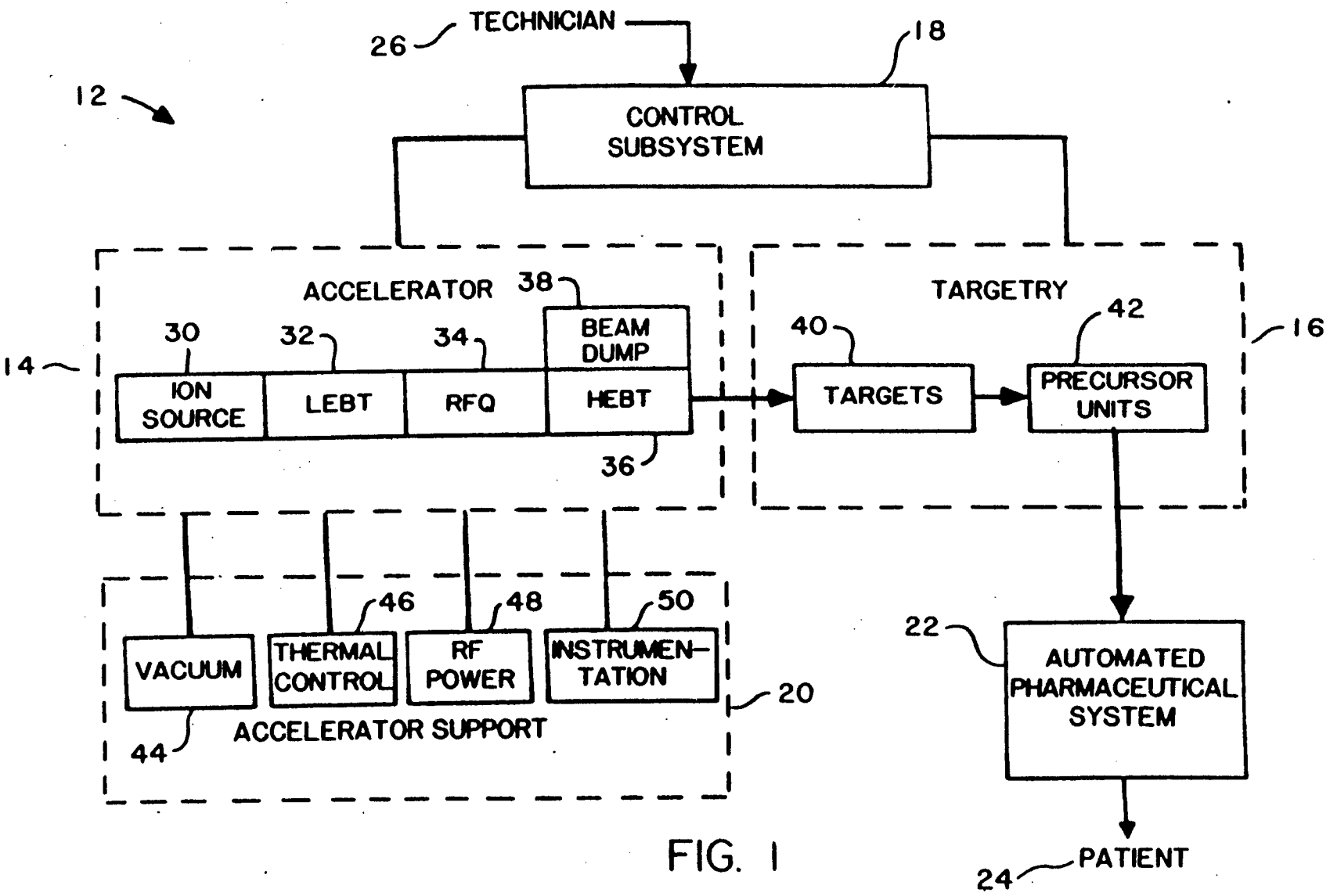
FIG. 1 is a block diagram of the RFQ-based PET radionuclide production system of the present invention.

Referring first to FIG. 1, a block diagram of a system 12 for producing radionuclides for application to PET is shown. Essentially, this system includes an accelerator subsystem 14, a targetry subsystem 16, a control subsystem 18, and an accelerator support subsystem 20. (Hereafter, these subsystems may be referred to by their identifying name without including the term "subsystem" therewith, e.g., the targetry 16. Moreover, the terms "subsystem" and "system" may be used interchangeably.) It is the function of the accelerator 14 to accelerate a beam of $^3He^{++}$ ions to an energy level of approximately 8 MeV. It is the function of the targetry 16 to receive this accelerated beam, expose a target material thereto, and generate selected precursors from the resulting radionuclides (created by irradiating the target material with the accelerated beam). In turn, these precursors are presented to an automated pharmaceutical system 22 that is programmed to produce one or more desired radiopharmaceuticals used by a patient 24 undergoing PET. The control subsystem 18 provides the control signals for automatically operating the accelerator 14 and the targetry 16, as initiated by a technician 26. Similarly, the accelerator support system 20 provides the necessary support functions associated with the operation of the accelerator, e.g., vacuum pumps, cooling mechanisms, and the like. Operation of these support functions is monitored and controlled (as required) by the technician 26 through the control subsystem 18.

The accelerator 14 includes an ion source 30 for generating (or otherwise producing) the $^3He^{--}$ ions used by the system. This source may be conventional, such as a duoplasmatron ion source. Advantageously, $^3He$ is commercially available at a modest cost. The ions from the source 30 have a low energy associated therewith, on the order of 0.05 MeV.

The low energy ions from the source 30 are presented to a Low Energy Beam Transport (LEBT) apparatus 32 where they are focused and otherwise tailored for injection into a Radio Frequency Quadrupole (RFQ) linear accelerator ("linac") 34. The RFQ linac 34 accelerates the beam to an energy of 8.0 MeV. A High Energy Beam Transport (HEBT) apparatus 36 then directs or presents the beam to the targetry 16. The HEBT 36 may be any suitable apparatus as is known in the art, e.g., a series of magnets or simply a beam pipe through which the high energy beam drifts. The accelerated beam may be selectively directed to a beam dump apparatus 38, e.g. a block of lead, in the event portions of the accelerator 14 are being tested and it is not desired to direct the beam to the targetry 18.

Advantageously, the RFQ-based accelerator system 14 has no beam activation problems as are common with prior art proton/deuteron beam systems. There is very little beam loss within the RFQ and there is no beam loss associated with the extraction process. Further, no shielding is required around the RFQ 34, thereby significantly reducing the quantity of shielding required. Moreover, accelerator maintenance is not complicated by shielding enclosures or activation problems.

The accelerated beam, after drifting a short distance through the HEBT 36, passes through a vacuum isolation valve into the isotope-production targetry system 16. The beam is allowed to expand during this drift to reduce the power density on the thin foils separating the accelerator vacuum from the target material (usually a gas) in the targetry system. The targetry system 16 includes at least one target material 40 and a plurality of precursor units 42. When the target 40 is bombarded with the high energy beam from the accelerator 14, various reactions occur (known to those skilled in the art) resulting in the creation of certain radionuclides. Further details concerning preferred target materials, the reactions that occur, and the resulting precursors obtained, are presented in Appendix A.

As has been indicated, one of the advantages of the present invention is that the targetry 16 may be realized using commercially available target systems, modified only to accommodate $^{3}He^{++}$ targets. An example of such a system is the target handling system manufactured by Scanditronix of Sweden. Such commercially available targetry subsystems may include, either as an integral part thereof or as an option, a suitable automated pharmaceutical system that programmably utilizes the precursors to produce a desired radiopharmaceutical. Because the targetry system 16 and the automated pharmaceutical system 22 are generally known in the art, further details associated with the systems will not generally be presented herein.

Of particular interest, and unlike most reactions for proton and deuteron-based systems which involve neutrons in the final state, most of the $^{3}He$-based reactions involve a charged particle in the final state. Such particles can be easily shielded by sheets of aluminum or the target casing itself. Accordingly, the $^{3}He$-based reactions of the present invention significantly reduce the neutron production in the targets relative to that in the proton and deuteron targets. For example, if the radioisotope produced by the present invention is $^{11}C$, the ratio of neutrons produced to radionucleus produced is 0.5. If the radioisotope produced by the present invention is $^{18}F$, the ratio is 0.08. Since $^{18}F$ is by far the most widely used PET isotope, the present invention is thus ideal for its production because of this low ratio of neutrons/radionucleus. This low neutron production significantly reduces the shielding requirements of the system.

Still referring to FIG. 1, it is seen that the accelerator support 20 includes a vacuum subsystem 44, a thermal control subsystem 46, an RF power subsystem 48, and an instrumentation subsystem 50. These subsystems are described more fully below in connection with the descriptions of FIGS. 3 and 8–10.

Figure 2:
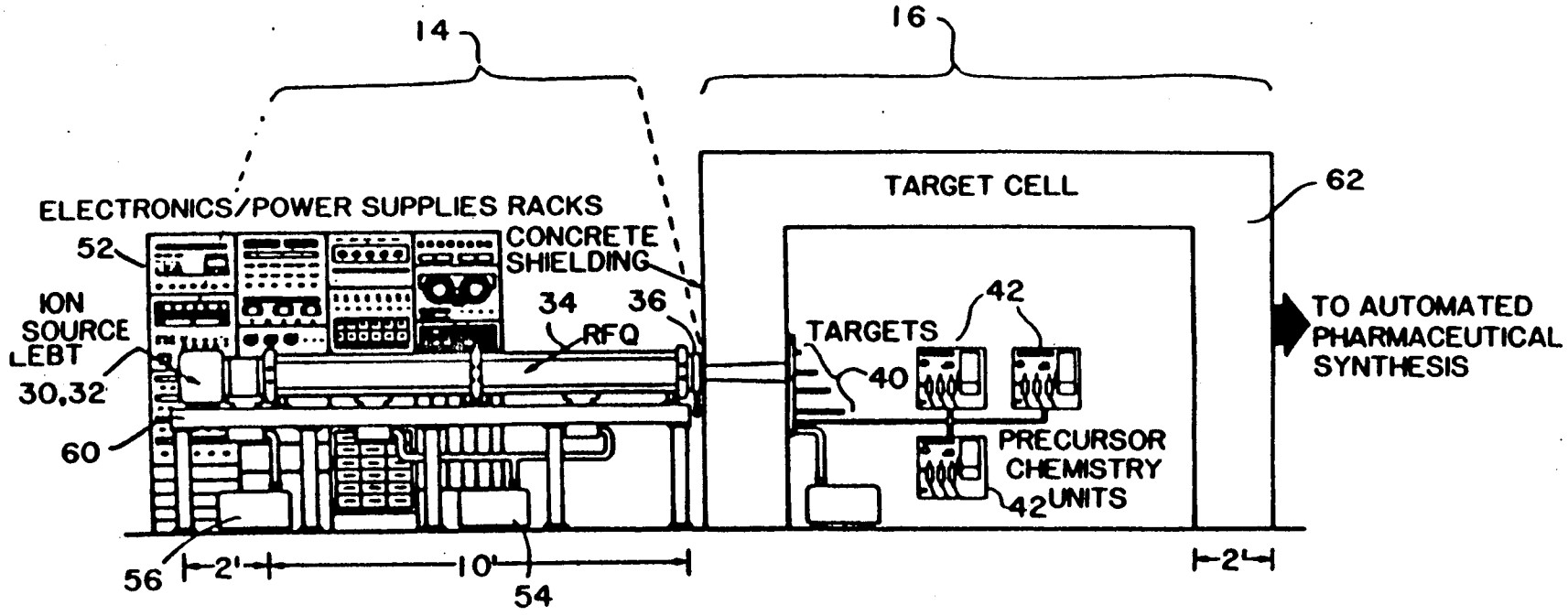
FIG. 2 is a pictorial diagram of the system of FIG. 1.

Referring next to FIG. 2, a pictorial diagram of the system 12 of the present invention is shown. This figure is presented primarily to illustrate the relative sizes of the various components of a preferred embodiment of the system 12. As shown in FIG. 2, the control subsystem 18, as well as portions of the accelerator support subsystem 20, are generally included in standard size electronic equipment racks 52 placed adjacent the accelerator 14. Other portions of the accelerator support subsystem 20, such as pumps 54 and 56, and associated tubing or plumbing, as well as suitable mechanical support structure 60 (e.g., a rigid table upon which the RFQ 34 is mounted) are positioned at convenient locations around (e.g., under) the accelerator 14. In this preferred embodiment, the RFQ linac 34 is only 3.4 meters long and is enclosed in a 0.3 meter diameter vacuum tank. Thus, the length of the linac 34 is approximately ten feet, while the ion source 30 and LEBT 32 are only about two feet in length, making the overall length of the accelerator system only about twelve feet.

The rf (radio frequency) power requirement for the RFQ structure and beam is about 400 kw peak or 8 kw average assuming a 2% duty cycle. This power is provided by 16 small power amplifier tubes (FIGS. 5D, 5E), mounted inside the RFQ vacuum tank and close coupled to the linac structure. The linac structure and power amplifiers are cooled by two separate water cooling systems, described more fully below in connection with FIG. 8. The RFQ tank is evacuated by two turbomolecular pumps to an operating pressure of about $1\times10^{-6}$ Torr. The entire vacuum system is described more fully below in connection with FIG. 7. The performance and operational parameters of the RFQ linac 34 are summarized below in Table 1.

TABLE 1

| RFQ Linac Parameters | | |
|---|---|---|
| Particle | He3++ | |
| Frequency | 425 | MHz |
| Charge | 2 | proton units |
| Structure length | 3.40 | m |
| Injector voltage | 25 | kV |
| Input energy | 50 | keV |
| Output energy | 8.0 | MeV |
| Ion source current | 30 | mA |
| Output current | | |
| electrical | 15 | mA |
| particle | 7.5 | mA |
| Output emittance | .005 | cm-mrad |
| Pulse repetition rate | 120 | Hz |
| Pulse length | 166 | us |
| Pulse duty factor | 2.0 | % |
| Average current | | |
| electrical | 300 | uA |
| particle | 150 | uA |
| Radial aperture | 0.15 | cm |
| RF power | | |
| cavity (peak) | 280 | kW |
| beam (peak) | 120 | kW |
| total (peak) | 400 | kW |
| total (average) | 8 | kW |
| Weight (RFQ) | 300 | kg |

Still referring to FIG. 2, it is noted that the racks 52 of electronic equipment are roughly eight feet in length, two or three feet in width, and typically no more than six or seven feet in height. Hence, the accelerator 14, including its support subsystems 18 and 20, can be placed in an extremely compact space compared to the cyclotron-based systems of the prior art (which systems typically occupy at least three times the floor space as do the equivalent components of the present invention). Moreover, the concrete shielding 62 placed around the targetry 16 need only be two feet in width, compared to the minimum of four feet in width that is used by equivalent target systems employed in a proton/deuteron-based system.

Figure 3:
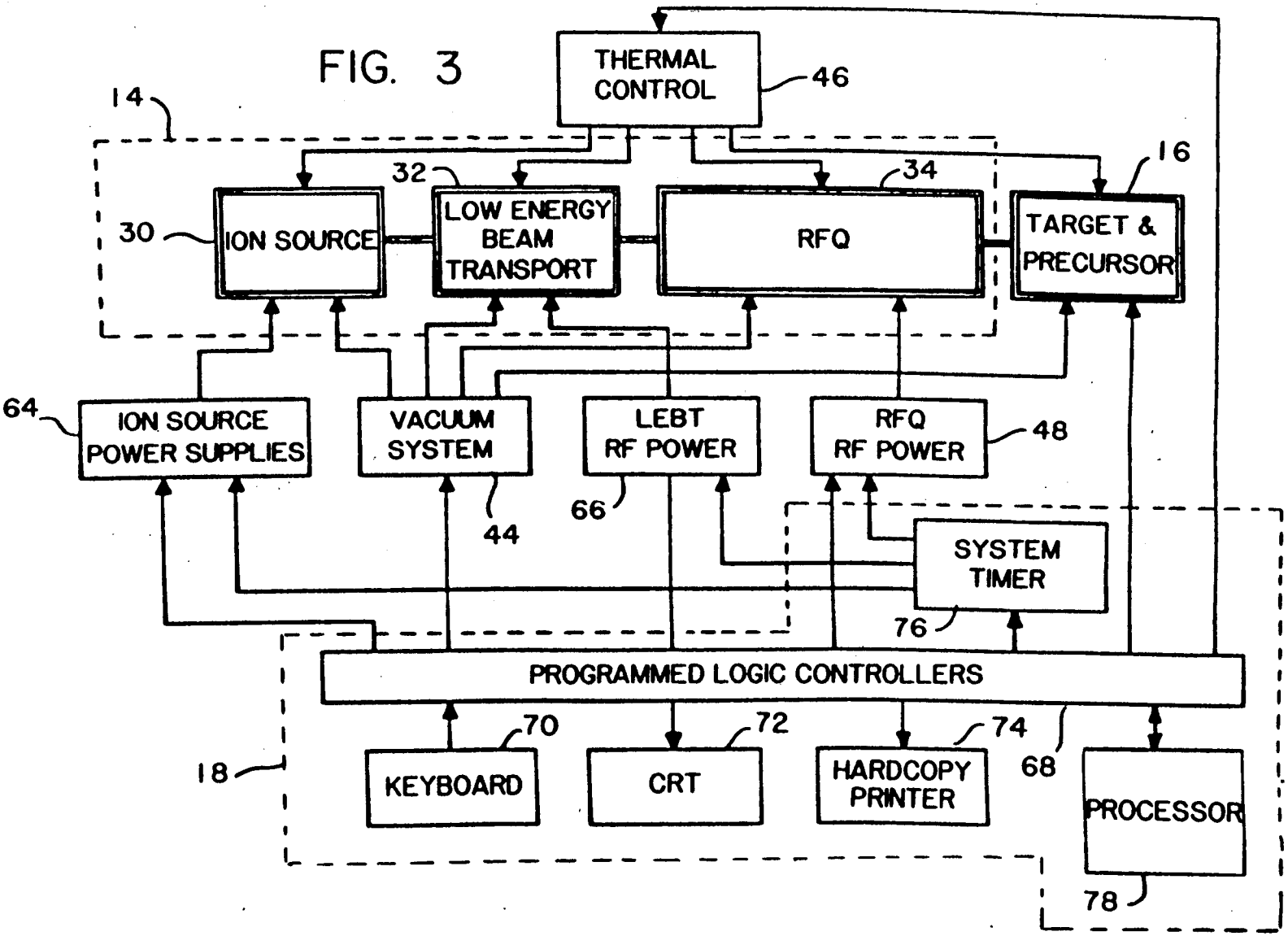
FIG. 3 is a more detailed block diagram of the present invention with emphasis on the control features thereof.

Referring next to FIG. 3, a more detailed block diagram of the radionuclide production system of the present invention is shown, with emphasis on the control features and elements thereof. This diagram will be explained by discussing the control and operation of the main components thereof, i.e., the ion source 30, the low energy beam transport 32, the RFQ 34, and the targetry subsystem 16.

Referring first to the ion source 30, this source is preferably a conventional duoplasmatron operating at 25 kV. Such an apparatus produces energies of 50 keV for the doubly charged helium ions. The duoplasmatron comprises two major assemblies: a plasma generator and an extraction electrode assembly. Helium-3 gas, which is readily commercially available from numerous sources, is injected into the plasma generator and is ionized through an arc discharge with electrons emitted from a heated filament. A focussing magnetic field is placed at the aperture of the source to enhance the ionization efficiency of the ion source. The generated plasma flows out of a small aperture in the anode and becomes the source of ions that are extracted through the extraction electrode.

A suitable duoplasmatron that can be used as the ion source 30 is the model Ionex 740A, manufactured by General Ionex Corporation. This device provides an output current (ion flow) of 30 mA. This is more than sufficient for proper operation of the RFQ 34, and the additional capacity provides a margin of performance, thereby insuring that sufficient current is always available at the input to the RFQ.

The gas flow rate from the ion source 30 is preferably maintained at less than 0.01 Torr-liter/sec. This is achieved by maintaining the ion source at operating pressure of $10^{-5}$ Torr with the vacuum system 44. The source of helium-3 gas is stored in a small bottle located in one of the equipment racks 52 (FIG. 2) and transported to the ion source 30 by flexible tubing. Advantageously, helium-3 gas is commercially available at a cost of around $160/liter. The estimated cost for a $^3$He RFQ facility is only about $2,700/year, thereby contributing to the low operating cost of the system.

The ion source 30 is mounted on one end of the accelerator assembly 14 in a metal enclosure. This enclosure further serves as a grounded shield around the plasma generator, which is at a potential of 25 kV. The plasma generator is about 17 cm in diameter, 21 cm long, and is isolated by a vacuum tight, electrically insulating cylinder. Because the plasma generator operates at a relatively low voltage, atmospheric air is used for electrical insulation in the ion source housing.

Four Ion Source power supplies 64 provide the various dc voltages and currents required to operate the ion source 30. Three of these supplies (arc, filament and magnet) are at the plasma generator potential and are isolated by 20 kV from ground. In the preferred embodiment, the Arc supply is adjustable to 150 V dc, and provides a pulsed output current of up to 10 amps. The rise time of the arc current is carefully controlled by a transistorized modulator so as to provide a beam current rise time of a few microseconds. The repetition rate is also adjustable over a range of 100 Hz to 1.2 kHz through the control system. The power supply operates from a single 120 V, single phase, 60 Hz isolated ac power source.

The filament power supply, used to supply a current to the filament of the plasma generator, is adjustable from zero to 8 V dc, and supplies a current of up to 80 A. Power is derived from the isolated 120 V, single phase, 60 Hz ac power source.

The magnet power supply, used to power the focussing magnets of the ion source, is adjustable from zero to 75 V dc, and provides up to 4 A of current. It also operates from the 120 V, single phase, 60 Hz isolated ac power source.

The extraction power supply is adjustable up to 30 kV dc and provides currents of up to 50 mA pulsed and 0.5 mA continuous. This power supply also operates from the 120 V, single phase, 60 Hz ac power source, and is referenced to ground potential.

All of the power supplies 64 contain internal regulators to stabilize the output voltage and/or current to within 1% of the required value due to variations in line voltage (±5%) and load impedance (±10%). The voltage ripple at the dc output of the power supplies should be kept at less than 1% to ensure proper operation of the ion source 30.

The power supplies 64 are controlled, and their status monitored, through the computer based control system 18. Those power supplies referenced to the ion source potential (20 kV) also have a fiber optic control interface so that the critical control components will be at ground potential. High speed analog voltage and current waveforms are transmitted to the control system through fiber-optic coupled Voltage-to-Frequency convertors.

The ion source power supplies 64 are preferably located in free standing, grounded metal enclosures that are part of the equipment racks 52, and are conveniently positioned near the accelerator. A high voltage insulated power cable assembly couples the three isolated power supplies and up to eight channels of instrumentation and control signals to the elements of the ion source 30. The exterior of this power cable is a flexible metal tubing which is grounded for personnel safety and protection. All of the power supplies 64 may be obtained from commercially available sources.

Turning now to the Low Energy Beam Transport (LEBT) system 32, the function thereof is two fold, namely: (1) to accept the charged particle beam from the ion source 30 and to focus it into a strongly converging beam for injection into the RFQ 34; and (2) to provide a high-conductance vacuum port for pumping the gas load that emanates from the ion source.

Conventional apparatus, known to those skilled in the art, is used to achieve these two functions. The beam entering the LEBT 32 is focused using an rf conventional beam lens configuration. This beam lens configuration, based on rf electric fields, has a strong focal action for low energy particle beams. Further this particular lens configuration may be used at a substantially lower frequency than the RFQ frequency. Rf power for the lens is produced by an LEBT rf power source 66.

As is known to those skilled in the art, the rf beam lens has distinct advantages over electrostatic quadrupole lens combinations in that no high voltage insulators are required to support the resonant electric fields, and the temporary alternation of polarity of the fields provides the alternating gradient feature required by the particle beam dynamics. Moreover, the beam maintains a near circular cross section throughout the lens which has important consequences in preserving the emittance of space-charge dominated beams. Further, the lens has the same focal length in both transverse planes and is tunable in both planes simultaneously by a single knob—the rf field amplitude. Advantageously, the lens has no frequency or phase constraint relative to the RFQ linac, and is thus easily activated by simply energizing the rf power source 66.

Still referring to FIG. 3, and also to FIGS. 4A and 4B, the RFQ linac 34 will now be described. As has been indicated, the preferred RFQ linac 34 for use in the system 12 is a commercially available RFQ device available from Science Applications International Corporation of San Diego, Calif. The description of the device herein is presented is intended only to clearly show how this commercially available device is integrated into the radioisotope production facility of the present invention. Essentially the RFQ 34 is a cylindrical pipe 80, loaded with four scalloped vanes 82. The vanes are installed in a high vacuum enclosure, and excited with rf power. The vacuum system 44 provides the requisite vacuum, and the RFQ rf power system 48 provides the requisite rf power. The vane tips define a tiny aperture 84 along the axis of the cylinder through which a particle beam passes. The rf power excites an rf cavity mode that has a strong quadrupole electric field pattern in this aperture that focuses the particle beam, keeping it small and away from the vane tips. Ripples on the vane tips introduce a longitudinal component of electric field along the axis that accelerates the particle beam.

The pipe or tube 80 is the main structural element of the RFQ. This tube and the four vanes 82 are made from aluminum. The vanes are mounted inside the tube on a number of concentric push/pull screw assemblies 86. These assemblies 86 hold the vanes 82 in position and provide for their precise alignment using conventional means such as micrometer threads, precision alignment surfaces, and a locking plate. The majority of the external surfaces are copper plated for electrical conductivity. The vacuum requirement is enormously simplified by surrounding the entire RFQ assembly 34 with a simple vacuum manifold, thereby eliminating hundreds of vacuum seals that would otherwise be required. Advantageously, the RFQ design provides low fabrication costs, lightweight structure, easy assembly and disassembly, removable vanes, design flexibility, rigidity, superb alignment capabilities, and excellent vacuum properties.

The cross section of the preferred RFQ cavity is shown in FIGS. 4A and 4B. The RFQ resonates at 425 MHz and has an inside diameter of 6.200 inches (15.748 cm), a radial aperture of 1.5 mm, and constant vane-tip radius of 1.28 mm. As has been indicated, the mechanical design is based on the use of a heavy-walled aluminum tube 80 (8" OD, 6" ID) as the main structural element of the assembly. After all welding on the assembly is completed, the assembly is stress relieved before final machining. The latter includes boring the inside of the cylinder to the precise diameter of 6.20 inches, and machining four precision flats 88 on the outer surface of the cylinder. Extreme care must be taken to insure that these flats are parallel to and equidistant from the axis of the interior surface and parallel or perpendicular to each other. The preferred RFQ is 3.4 meters long and is configured as two 1.7 m long RFQ's connected in tandem. Fabrication and operational advantages result from this end-to-end configuration over a single-long-tank configuration.

The four RFQ vanes 82 are mounted inside the heavy-walled aluminum tube (the vane housing) as shown in FIGS. 4A and 4B. Electrical contact between the vanes and the vane housing is based on flexed fins at the base of the vanes, which are designed to produce a force of 100 pounds/inch or greater against the vane housing. The range of fin flexure is designed to allow mechanical alignment of the vanes with a tolerable effect on this contact force.

Figure 5B:
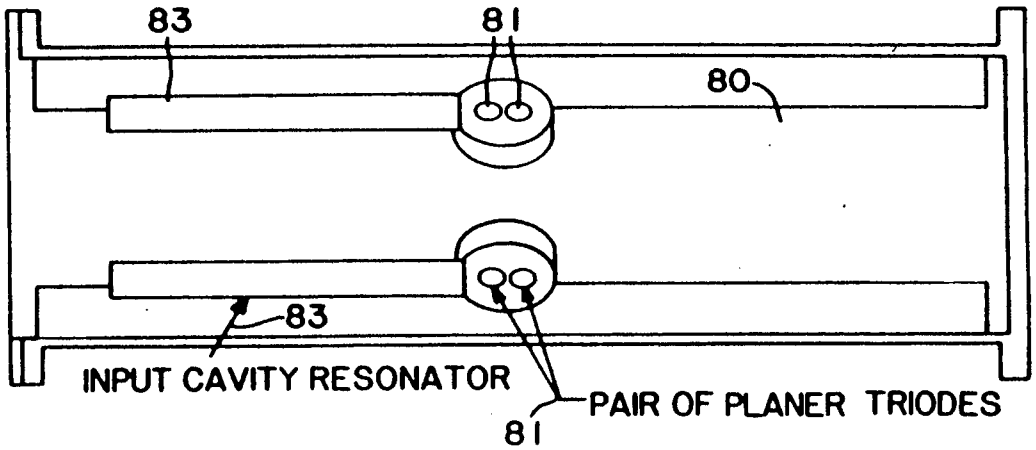
FIG. 5B is a side view of one section of the RFQ accelerator showing the preferred manner of supplying rf power thereto using four pairs of planer triodes, each pair being coupled to an input cavity resonator or power tube.

Each vane 82 is held in position by 14 pairs of concentric push/pull screw assemblies 86 as shown in FIG. 5B. The pushing screws have a micrometer thread to the vane housing and form the vane-base alignment surfaces. The pulling screws serve to pull the vane bases against these alignment surfaces. The locking plates load the alignment screw threads to prevent accidental movement. The RFQ vanes 82 are designed in conventional manner with the vane tips extending close to the end plates of the RFQ cavity with a cutout between the vane tips and the vane bases to allow the rf magnetic fields to wrap around the ends of the vanes. A profile, end and side views, of the vane termination is shown in FIG. 5A. The gap between the vane tip and the end plate is 0.500 cm. the cutout has an area of about 13.2 $cm^2$. The vane base makes electrical contact with the end plate through a segment of a spring ring in a groove in the end of vane base.

Preferably, the vanes 82 are fabricated from the aluminum alloy 7075, which has the best spring properties for the flexed fins. The vane material is purchased as rectangular bars with gun-drilled cooling channels through their long dimensions. The bars, bolted to a rigid machining fixture, are machined to the desired cross section by conventional CNC milling machines. At this stage, the vane tip is still in the form of a rectangular blade 0.256 cm thick. The ends of the vanes are cut off and contoured by a computer-controlled wire electrical discharge machining (EDM) process. The last step in the machining of the vanes is to put the delicate contours on the vane tips.

The longitudinal vane-tip profile involves a numerical solution of the idealized RFQ potential function. Computer Aided Machining (CAM) processes translate most cutting processes into straight line segments and circular arcs. Using these segments, the standard vane-tip profile between a peak and an adjacent valley is translated into three segments, namely a circular arc, a straight line, and a circular arc, in such a way as to preserve the height and location of the peak, the depth and location of the valley, the slope at the midpoint between the peak and valley, and a smooth interface between all segments.

At the input end of the RFQ 34, the radial matching section is blended smoothly into the radial cut forming the end of the vane tip. At the output end of the RFQ, a circular arc, of one-centimeter radius, is appended to each vane, blending smoothly with the radial cut forming the end of the vane tip.

The constant vane-tip-radius design allows the use of a special shaped cutter for contouring the vane tips, which greatly reduces the cost of the vane-tip machining. As is known to those skilled in RFQ design, the radius of this cutter must come from the geometrical details of the vane-tip profile itself. The constraint is simply that the tool radius must be smaller than the minimum concaved radius of the vane-tip profile.

The interior surface of the vane housing and the majority of the vane surfaces are copper plated (UBAC-R1 process) for electrical conductivity. The vane tips are left unplated as a precaution against possible problems with copper plating in the region of high field and critical geometry. The exterior of the vane housing and flanges are anodized black to provide a smooth stable surface for precision alignment measurements.

The RFQ assembly process starts with the installation of the 48 micrometer-thread pushing screws of the assemblies 86 that form the alignment surfaces and the 24 locking plates that restrict their motion. The pushing screws are initially set to their nominal position relative to the flats on the exterior surface of the vane housing. The vanes 82 are installed to their nominal positions, one at a time, in any order. They may be aligned as they are installed or the alignment may be postponed until several or all have been installed. After the vanes are installed, the position of the vanes is adjusted by moving the pushing and pulling screws to achieve the desired gap spacing. The counteracting forces from the pushing and pulling screws keeps the vane position under positive control and contributes to the alignment accuracy achievable from this design.

Advantageously, all of the measurements required to align a vane, or to check its alignment, can be made at any time without regard to the status of the other vanes. The primary reference for all alignment measurements are the four flat surfaces 88 accurately machined on the outer surface of the vane housing. The vane alignment is based on depth-micrometer measurements from these flats through holes in the housing and the vanes, to selected flat portions of the vanes.

Figure 5C:
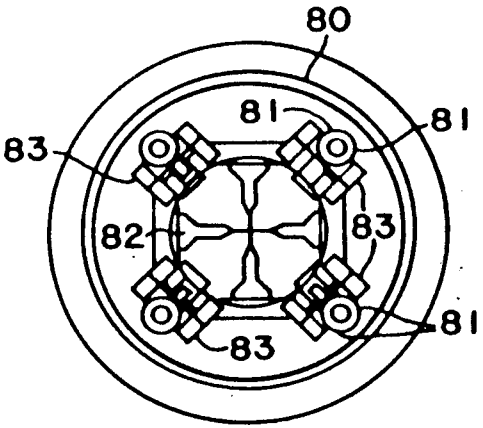
FIG. 5C is an end view of the RFQ section of FIG. 5B.

Referring for a moment back to FIG. 3, the rf power system 48 provides the power that accelerates the $^3He^{++}$ beam to the desired energy level. As indicated above, the RFQ is configured as two 1.7-m-long sections in tandem. Each of these sections requires 200 kw of rf power (peak). The power for each section is supplied by 8 small planar triodes 81 mounted directly on the RFQ cavity wall inside the RFQ vacuum enclosure. The 8 tubes are mounted in pairs on each of the four quadrants of the structure as shown in FIGS. 5B and 5C. Each pair is driven in parallel by one input cavity resonator 83.

This close-coupled scheme offers many advantages over conventional rf power systems. For example, the close-coupled scheme: (1) eliminates the need for separate rf output cavities for each power source; (2) eliminates the need for transmission lines between each power source and the linac; (3) eliminates the need for high-power rf windows for each transmission line; (4) replaces the conventional rf drive loop with an integrated drive loop for each power source or cluster of power sources; and (5) provides a convenient, rigid, mechanical support for each power source.

Suitable planar triodes are commercially available from, for example, Eimac Corporation of Salt Lake City, Utah. The Eimac planar triodes (Models Y-690, YU-141, YU176) produce 30 kW of rf power with a 2% rf duty factor and an efficiency of 60%. They are small in size and relatively low in cost.

Further advantages provided by powering the linacs with a multiplicity of smaller power units exist. For example, it is relatively easy to survive the failure of any one unit by calling on some reserve power from the remaining units. Also, the system hardware, being small in size and large in number, results in favorable design and fabrication costs.

As is known to those skilled in the art, the planar triode operates well in a "grounded grid" configuration. This implies that the anode and the loop operate at an elevated potential (6–8 kV) and should have considerable capacitance to ground (200 pf or more). Using the required electrical insulation as the dielectric of the required rf bypass capacitor results in a compact and rigid configuration. The anode cooling water enters the anode bypass capacitor ring, passes through the loop to the anode cap, and then back through the loop and capacitor ring on the way out.

Each cluster of triodes requires a grid/cathode circuit, typically involving a resonant input cavity. The configuration shown in FIGS. 5D and 5E involves a three-quarter wavelength coaxial cavity with the outer conductor grounded, a tuning stub at the far end, and the open end of the center conductor connected to the cathode. The four input cavity resonators on each section are driven in-phase through a four-way power splitter and equal-length lines.

In summary, close-coupled, loop-drive, rf power sources, using the linac resonator itself as their output resonator and power combiner, offer substantial savings in the cost, complexity, weight and efficiency of rf power sources for linac applications. All problems associated with the extraction of the rf power from the power source, transmission of the rf power to the linac, and the injection of the rf power into the linac are solved, in the simplest way, by the close-coupled configuration. The system control is further simplified by eliminating concerns over reflected power and standing waves in the non-existent transmission lines.

Turning now to the control aspects of the present invention, and referring back to FIG. 3 momentarily, it is seen that the control system 18 includes a control processor 78 and a plurality of Programmed Logic Controllers (PLC's) 68 that interface with a conventional keyboard 70, a CRT 72, and a printer 74. (In FIG. 3, the keyboard, CRT, and printer are shown as interfacing with the PLC 68. However, it is to be understood that these devices may interface directly with the processor 78.) Essentially, the PLC's 68 include a programmed microprocessor, or equivalent device, that is programmed in a specified manner so as to perform a desired function. From an operator point-of-view, for example, the accelerator system has three states: "standby", "ready", and "run". Transitions between these states is essentially a push-button operation. The transition from "standby" to "ready" involves approximately a five minute delay for component warm-up. The other transitions are essentially instantaneous. From a system point-of-view, however, the control system handles all of the automated tasks of closed loop and logic control. A system timer 76 augments the operation of the PLC 68 by generating the controlled time signals that are used in the pulsed RFQ system. The system timer 76 is discussed in more detail below in connection with FIG. 6.

In general, the control system provides the following automated functions: system startup, with proper warm-up periods (5 minutes from a cold start), and component monitoring; run programming, including target selection, duration of irradiation, and logging with hard copy printout; continuous monitoring of RFQ operating parameters, with appropriate protective interlocks or warnings; color CRT display of operating parameter, interlock status, and irradiation parameters; and fault finding guides to locate malfunctions rapidly and simply. The computer or processor 78 provides the system 12 with all the control instructions and also monitors the important parameters for the processing of the precursors. The software and hardware for controlling the targetry system 16, including the precursor units 42, is provided with the commercially available targetry systems. Other software for controlling the accelerator 14 can be readily incorporated into this commercially available equipment by those skilled in the art in order to provide a user friendly, hospital-proven control system for a clinical environment.

Figure 6:
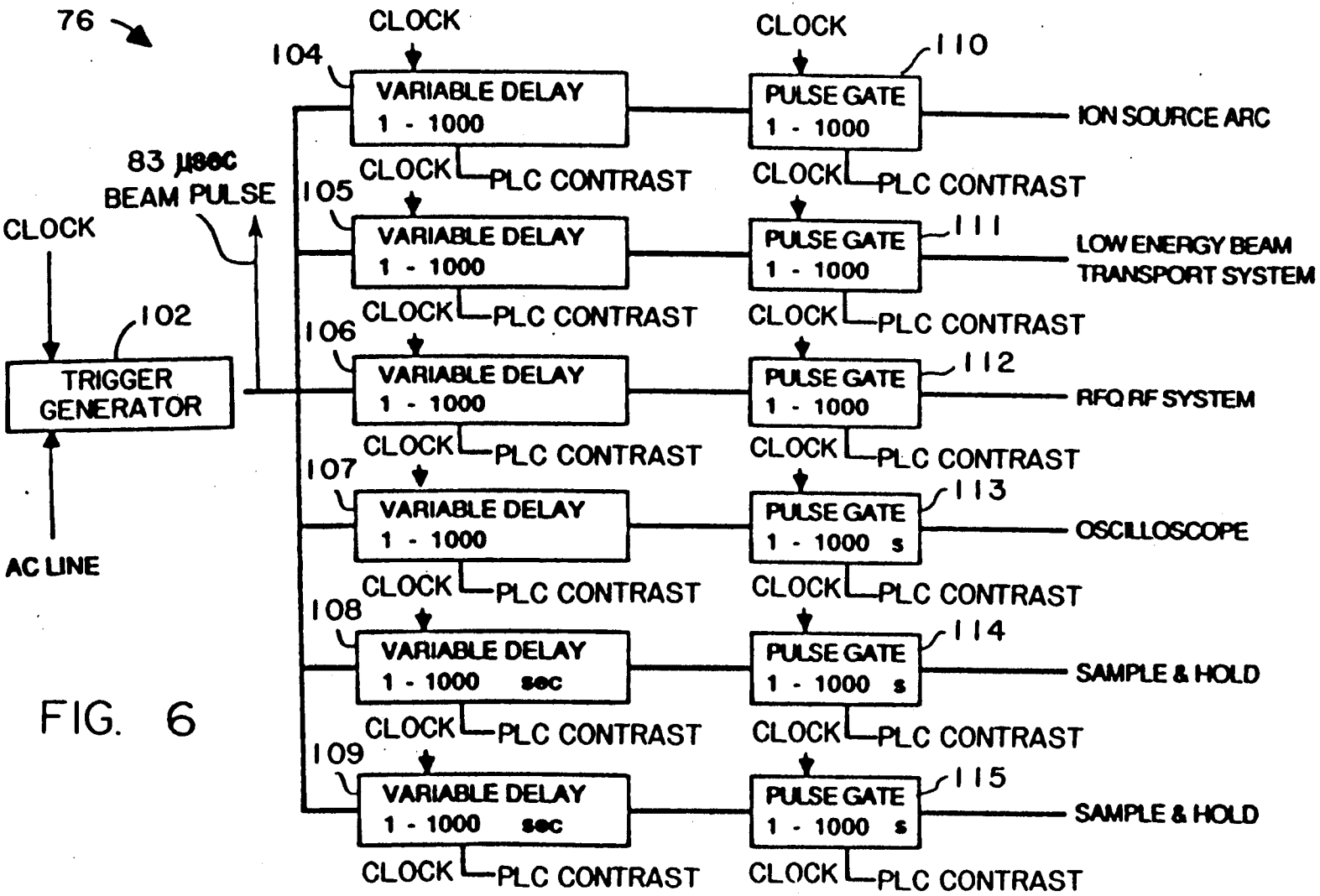
FIG. 6 is a block diagram of the system timer circuits used to provide the synchronized pulse signals throughout the system.

Because the RFQ-based accelerator is a pulsed system, a synchronizing clock signal must be distributed to all pulsed subsystems. To this end, a system timer 76 is used to generate the appropriate synchronized signals. A block diagram of the system timer 76 is shown in FIG. 6. The basic pulse rate of the accelerator is 120 Hz and is phase locked to the incoming AC power at trigger generator 102. The resulting beam pulse is 83 microseconds long. Pulses to the individual support subsystems are delayed up to 1000 μsec as required for timing of the support subsystems using variable delay circuits 104–109. Pulse gates 110–115, also variable up to 1000

μsec, are connected in tandem to the variable delay circuits 104–109, and drive the individual subsystems. The subsystems that require these timing pulses are the ion source 30, the low energy beam transport rf system 66, the RFQ rf system 48, and the simultaneous four target option system (FIG. 4). An oscilloscope, used to measure the system pulsed parameters, including the beam current, also receives timing pulses. One or more sample and hold circuits (not shown) may also receive these timing pulses. Such sample and hold circuits are used primarily to facilitate the measuring of other pulsed signals, especially when the results of the measurement are to be displayed on a suitable display device included in the console. The delays and widths associated with the timing pulses are set by the operator through the control system. The delay circuits 104–109 and the gates 110–115 are easily implemented by those skilled in the art using analog and/or digital commercially available components.

Figure 7:
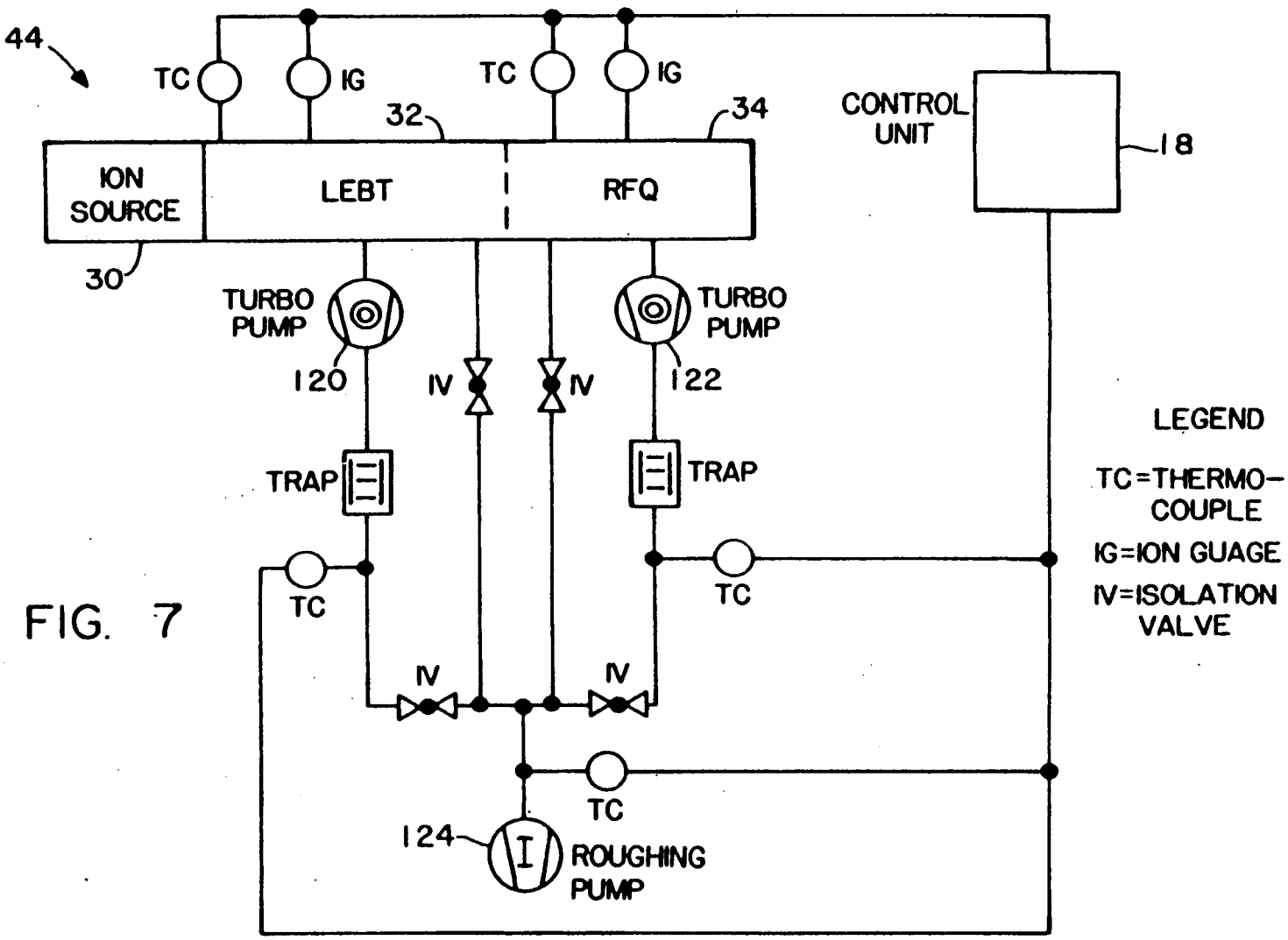
FIG. 7 is a block diagram depicting the vacuum subsystem utilized in the accelerator support subsystem of FIG. 1.

Referring next to FIG. 7, an elementary diagram of the vacuum system 44 is shown. Vacuum systems are, of course, known in the art. The description that follows is presented simply to illustrate the best mode in which known vacuum system components could be combined to serve the purposes of the present invention. Vacuum pumping is accomplished by two turbomolecular vacuum pumps 120 and 122, each connected to the vacuum enclosure. One pump is in the Ion Source/LEBT end of the enclosure and the other is in the RFQ end. The required pressure in the LEBT region is $10^{-5}$ Torr, or less during operation. In the RFQ area, the required pressure is $10^{-6}$ Torr, or less. These pressures are met with the two turbomolecular vacuum pumps 120, 122 each with a capacity of 450 liter/sec (385 liter/sec in hydrogen).

The two turbomolecular pumps and the vacuum enclosure are roughed by a single rotary-vane mechanical pump 124. Advantageously, the turbo pumps provide long term, reliable operation, requiring little maintenance. Cryogenic pumps may also be used, but it is believed that they would not offer the maintenance free operation provided by the turbo pumps.

The pumps are controlled and monitored through the control system 18. The pressure in the vacuum enclosure is also measured with both thermocouple and ion gauges. The details of operating and maintaining the vacuum system 44 are conventional, and are known to those skilled in the art.

Figure 8:
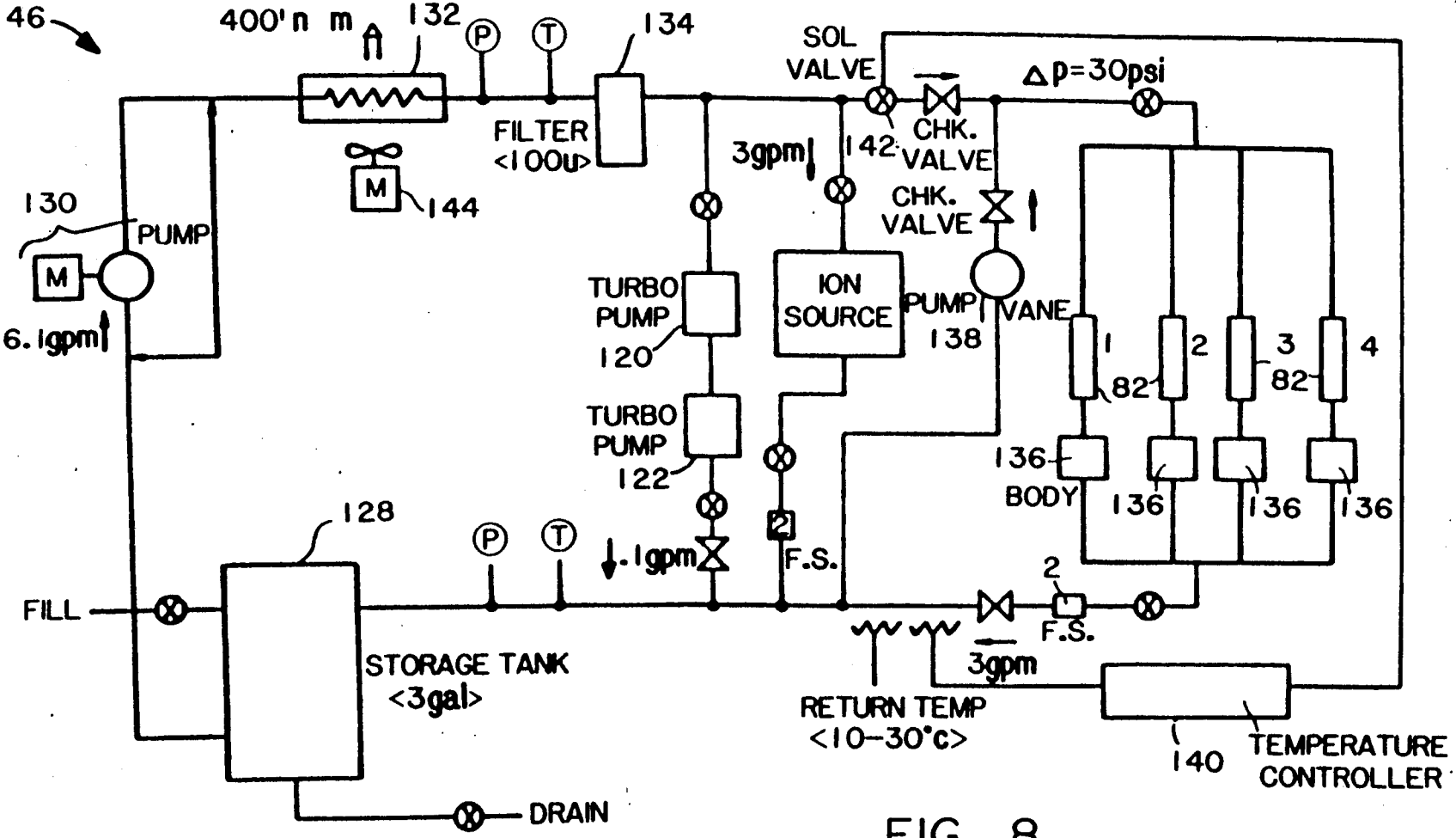
FIG. 8 is a block diagram showing the thermal control subsystem included in the accelerator support subsystem of FIG. 1.

Referring next to FIG. 8, an elementary diagram of the thermal system 46 is shown. Like the vacuum system, thermal systems are also known in the art. The description that follows is presented simply to illustrate the best mode of such a thermal system used with the present invention. A thermal system is required because several subsystems of the accelerator produce heat which must be removed. The function of the thermal system is to circulate low conductivity water through the components and remove the heat from the water by a water-to-air heat exchanger 128. To this end, the thermal system includes a primary pump 130 that pumps water from a storage tank 128 (at a rate of about 6 gallons per minute) through the water-to-air heat exchanger 132, through a filter 134, through one of three parallel paths (the ion source path, the vacuum system path, or the RFQ path), and back to the tank 128.

The RFQ path is most critical because the temperature rise of the vanes 82 must be tightly controlled. To keep the distortion of the vanes to a minimum, including the vane-to-vane spacing, the allowable temperature rise and variation of the coolant in the vanes should not exceed one degree Centigrade. To this end water flows through the four vanes 87 (parallel connected) and returns through copper tubes 136 that have been thermally bonded to each quadrant of the vane housing. Because of the direct contact of the water with the vanes, the temperature of the water is an accurate indication of the vane temperature. The temperature is stabilized by a temperature controlled feedback loop that includes a secondary pump 138 for recirculating the water back through the vanes 82. This loop further includes a temperature controller 140 coupled to a solenoid valve 142 which allows water from the heat exchanger 132 to be mixed with the RFQ water so as to maintain a constant temperature.

In the ion source path, it is estimated that 1100 W of power is dissipated in the ion source 30. To keep the temperature rise to less than two degrees Centigrade, about 3 gpm (gallons per minute) of cooling water is required. The vacuum system path, on the other hand, requires much less cooling, and only about 0.1 gpm of water is required.

The thermal system pump 130 is designed to produce a differential pressure of 40 psi (pounds per square inch) at a flow rate of approximately 6.1 gpm. The heated water from the pump, including the heat from the loads, passes through the water-to-air heat exchanger where a blower 144 moves 400 CFM (cubic feet per minute) of ambient air through the heat exchanger fins, thereby removing the heat from the water.

Figure 9:
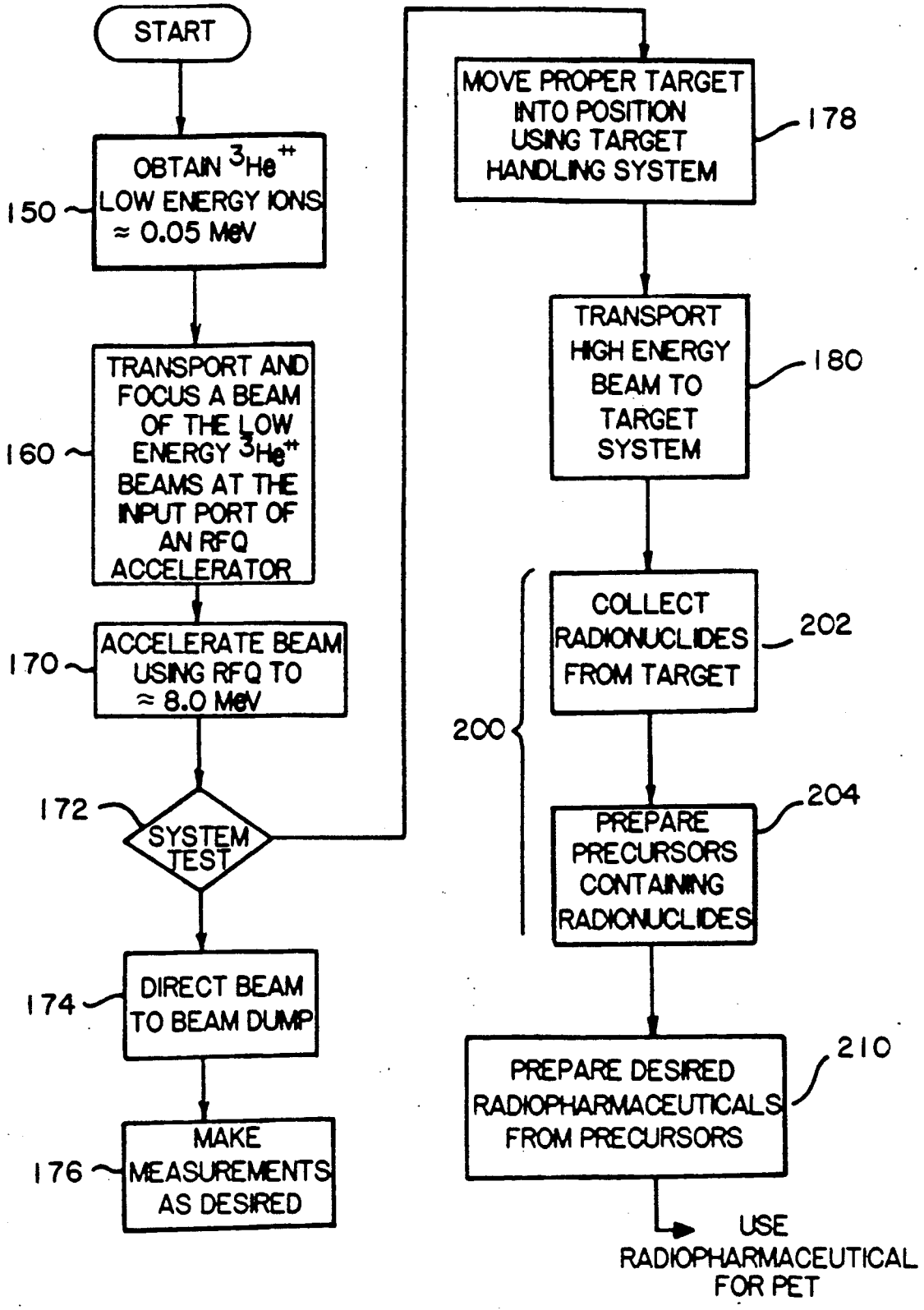
FIG. 9 is a flow chart illustrating the steps of producing radionuclides in accordance with the method of the present invention.

Referring next to FIG. 9, a basic flow chart illustrating the method of obtaining suitable radiopharmaceuticals for PET applications in accordance with the present invention is depicted. This method is preferably carried out automatically by the control system 18; but it could also be carried out one step at a time, with each step being initialized manually. The method includes the steps of: (1) obtaining low energy $^3He^{--}$ ions from a suitable source (block 150); (2) focusing these low energy ions into a beam and transporting this beam to the input port of an RFQ linac (block 160); (3) accelerating the beam using the RFQ linac to an energy of around 8.0 MeV (block 170); (4) transporting or otherwise directing the high energy beam into a target system (block 180); (5) irradiating a suitable target material with the high energy beam to produce radionuclides of interest (block 190); (6) preparing suitable precursors from the radionuclides (block 200) that can be used in (10) preparing desired radiopharmaceuticals (block 210) that have application to PET.

Should it be desired to test or calibrate the system without directing the high energy beam to a target material (block 172), then the beam is directed to a suitable beam dump (block 174), and the desired measurements or calibration steps are performed (block 176). The irradiating step includes moving the proper target into position using the target handling system (block 178), and then directing the high energy beam to the target (block 180).

Advantageously, the step of preparing precursors having application to PET (block 200) may include automatically and programmably collecting the radionuclides resulting from irradiation of the target(s) (block 202), and automatically processing the same to produce the precursors of interest (block 204).

A major advantage of the $^3He^{--}$ RFQ utilized by the present invention is that it is extremely light weight in comparison to a cyclotron (<0.5 tons compared to approximately 20 tons), yet the RFQ-based system can nevertheless produce the radioisotopes of interest ($^{18}F$, $^{13}N$, $^{15}O$, and $^{11}C$) in more than adequate quantities. The radioisotope $^{18}F$ is produced particularly copiously. Moreover, the $^{3}He^{++}$ target reactions have the property that fewer neutrons are produced per isotope nucleus than with low energy proton or deuteron based systems. This fact, coupled with the fact that helium-3 causes almost no neutron production in collisions with the accelerating structure, results in the elimination of the radiation shielding for the accelerator and a factor of nine reduction in total facility shielding weight (including the vault) compared to a proton/deuteron cyclotron facility.

Moreover, the natural exit of the beam from the linear structure of the RFQ, as opposed to the forced extraction from the circular cyclotron, also provides the additional advantage that component activation is minimized. Further, no enriched target materials are required. A single beam particle type can be used to produce all four isotopes, therefore avoiding particle switching. The entire system can further operate using approximately 20 kW of power, only about 20% of the power consumption for present cyclotron facilities. Finally, the RFQ beam cross section is circular, instead of the strongly elliptical shape from a cyclotron, thereby leading to better beam utilization in cylindrical targets.

Figure 10:
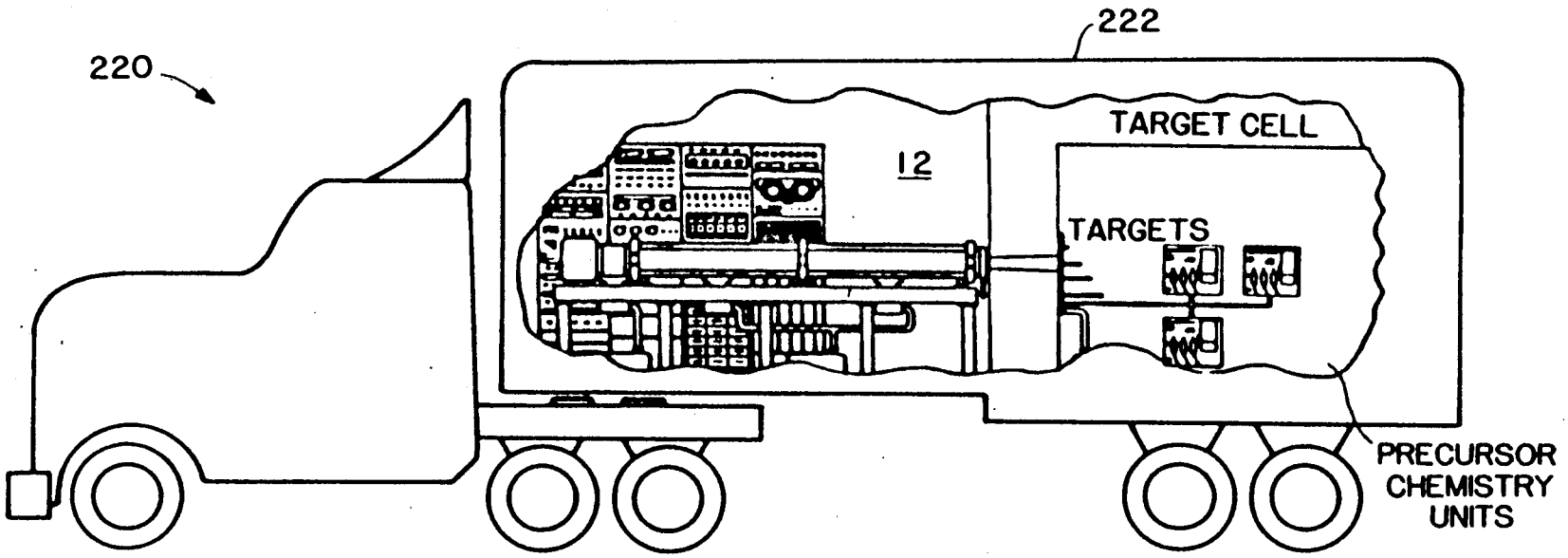
FIG. 10 depicts one manner in which the system of the present invention may be rendered transportable.

Advantageously, the order of magnitude reduction in facility weight, the virtual elimination of the accelerator weight, and the relative lack of activated components, gives rise to the possibility of a transportable radiopharmaceutical production system. Such a transportable system is illustrated in FIG. 10, wherein the entire radiopharmaceutical production facility 12 is installed in a tailer 222 of a conventional 18-wheel truck transport 220. Other suitable forms of transport, of course, could also be used, such as a railway car, or ship. A transportable system such as is shown in FIG. 10 makes the PET technique far more accessible geographically and financially than has heretofore been the case, thus representing a true advance in the PET technology art.

While the invention herein disclosed has been described by means of specific embodiments and applications thereof, numerous modifications and variations could be made thereto by those skilled in the art without departing from the spirit and scope thereof. Accordingly, it is therefore to be understood that within the scope of the appended claims, the invention may be practiced otherwise than as specifically described herein.

APPENDIX A

TARGET AND PRECURSOR SYSTEM DESCRIPTION

A.1 Target System

The target system description given here is for a single beam exit port design, and is just one of many target handling systems that are commercially available.

The accelerated beam is extracted from the RFQ through a single beam exit port. Mounted onto the beam exit port is the target support frame. It provides positions for mounting eight (8) gas, liquid, or solid target chambers. The targets are mounted on guides which slide within the frame and can be remotely operated from the main console.

The beam enters the target chamber through a double-foil assembly mounted on the target flange. The thin foils are cooled by high-speed helium gas flowing between them in a closed-loop system. This system removes heat from the target foil windows during irradiation. This system contains a recirculating pump, interlocks, interconnecting tubing, and controls. The foils facing the target and vacuum chambers are sealed with metal gaskets to minimize contamination. Organic seals are used elsewhere.

Due to the high current nature of the RFQ, an alternate windowless beam/target interface may advantageously be used. A windowless target system for the RFQ-based system is unique in that it offers advantages over windowless targets used with a continuous beam accelerator. In general, in a window target system the beam enters the target chamber through an opening, or "window." It is known in the art to eliminate the window by separating the target from the accelerator with a long thin beam tube, thereby resulting in a windowless target system. This beam tube is continuously pumped with a vacuum pump. The low conductance of the tube allows substantially different pressures to exist on the accelerator and target ends of the tube, which different pressures are necessary in order to efficiently operate the system. Disadvantageously, however, for a continuous beam accelerator, the pump system must work very efficiently (requiring substantial additional components and operating expense) in order to maintain the requisite pressure differential between the accelerator and the target.

An RFQ accelerator, however, is a pulsed system that provides a beam only about 2-5% of its operating time. Thus, the target end of the windowless target system as above described may be modified to include an aperture mechanism which provides a further vacuum boundary between the target and RFQ. This mechanism is pulsed open and pulsed shut in phase with the beam pulses. Thus, the interface is closed approximately 95% of the time, leading to a much improved vacuum isolation between the target and the RFQ.

Numerous types of pulsed mechanisms are available in the art that could be fitted by those skilled in the art within the target end of the beam tube in order to provide a pulsed aperture windowless target system as above-described. A schematic block diagram of the windowless target system is shown in Fig. A1.

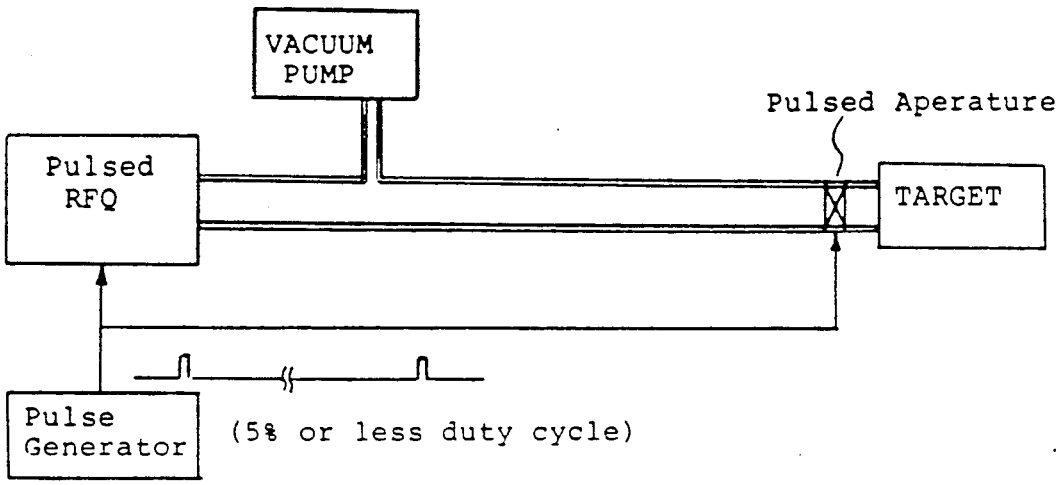

FIGURE A1. Windowless Target System

A.2 Targetry Issues

As previously indicated the preferred targets and target switching system are existing products of Scanditronix, of Uppsala, Sweden (and also having an office in Essex, Massachusetts), although any suitable target handling system of the types known in the art could be used. O-15 and N-13 precursors for clinical PET are limited to making $H_2O$, $O_2$, and CO with a 2 minute half-life tracer, and $N_2$ and $NH_3$ with the 10 minute half-life N-13 tracer. More complex organic molecules can be made with N-13. However no N-13 labeled radiopharmaceuticals other than ammonia have immediate clinical value. The O-15 target uses the $^{16}O(^{3}He,^{4}He)^{15}O$ reaction and is therefore very similar to a $^{16}O(p,pn)^{15}O$ target, presently used by the Scanditronix system.

The $^{11}C$ target can be produced by irradiating elemental C, however the product produced would be of much lower specific activity than is commonly achieved with current targets, e.g. $^{14}N(p,\alpha)^{11}C$. The ultimate role of $^{11}C$ radiopharmaceuticals in clinical PET is open to question; clearly the convenience of $^{18}F$ makes it the preferred tracer for organic molecules. Furthermore, all of the $^{11}C$ compounds presently under consideration for clinical PET are natural products (e.g. sugars, fatty acids, thymidine, amino acids) so that high specific activity is not essential. $^{11}C$ radiopharmaceuticals also require a longer list of precursors for radiochemical synthesis: $CO_2$, $CH_3I$ and $CN^-$ are a minimum.

The F-18 target is most conveniently produced as fluoride in water. This can be azeotropically dried by a robot and used for nucleophilic displacement reactions, completely analogous to current methods for handling F-18 from $^{18}O(p,n)^{18}F$ targets, except that the enriched $H_2{}^{18}O$ is recovered, purified, and reused; whereas with $^3He$ the water is naturally abundant with $^{16}O$. While many radiopharmaceuticals can be prepared from nucleophilic $^{18}F^-$, some require electrophilic $F_2$, e.g. 6-fluoro-DOPA. A target for irradiating molecular oxygen and then removing it from the target by addition of a small amount of molecular fluorine after the irradiation has been developed. This $F^{18}F$ is of acceptable specific activity for labeling DOPA. Since $^{18}F$ is presently the most commonly used PET isotope, it is important to note that $^{18}F$ production is at least as practical, if not more so for the $^3He$ system than the proton approach.

A.3 Automatic Precursor Units and Radiopharmaceutical Preparation System

A.3.1. Automatic Precursor Chemistry Units

Remote/automated chemical synthesizers are designed to produce all of the radiochemical precursors that are anticipated and to offer generic synthesis schemes for C-11 and F-18. Most of these precursor systems are the same as used by the present cyclotron systems. These precursors and estimates of the system yield are shown in Table A-1.

Table A-1 Precursor Yields*

| Precursor | Est. Yield | Precursor | Est. Yield |
|---|---|---|---|
| $^{11}CO_2$ | 700 mCi | $^{15}O_2$ | >100mCi |
| $^{11}CO$ | 350 mCi | | |
| $11CN^-$ | 350 mCi | $H_2{}^{15}O$ | >100 mCi |
| $^{11}CH_3I$ | 200 mCi | $C^{15}O$ | 60 mCi |
| $^{13}N_2$ | 250 mCi | $^{18}F$ (anhydrous) | 300 mCi |
| $^{13}NH_3$ | 75 mCi | $^{18}F_2$ | 100 mCi |

*Best estimate of practical yields.

A typical precursor unit is approximately 2 ft. high by 2 ft. wide and is "2-dimensional". That is, none of the components are located behind others. This simplifies maintenance. The units can be hung vertically on a wall for easy access.

The automated chemistry processing system provides the basic precursors and is controlled through a small computer which gathers data from strategically placed transducers and directs various I/O devices. The control console is freestanding and can be situated anywhere in the radiochemistry laboratory. The processing control cabinet should be installed near the hot cell area. The control cabinet houses the I/O interface, control relays, oven regulators, interlock status, and power supplies. Scanditronix provides complete software for production of radiolabeled precursors. The operator needs only to learn a simple startup procedure. The display test provides numerous prompts to assist in using the system to its maximum. Expansion is available for new processes. The system includes all the necessary ADC-DAC converters to control oven temperature regulators and mass flow controllers. Provisions are made for optional expansions in the system, including gas chromatographs and integrators.

A.3.2 Automated Radiopharmaceutical Preparation System Utilizing Robotics

Automated radiopharmaceutical preparation systems are known in the art. One such system is available from Zymark (Boston), and requires no modifications for this application since the precursor units are generating the same precursors as present systems. The use of a robot provides maximum flexibility, eliminates radiation exposure to the radiochemist or operator, and avoids the complication and inflexibility the "black box" approach. Essentially any labelled compound is synthesized with the system. Programs exist for generic chemical procedures for carboxylation reactions (e.g. acetate, palmiate), cyanide additions (e.g. deoxyglucose, C-1-glucose) and methylation under rigorously anhydrous conditions. The latter is the most important route to clinically useful C-11 radiopharmaceuticals. In particular, the robot is programmed to produce no carrier added 2-($^{18}$F)-fluoro-2-deoxy-D-glucose and ($^{11}$C) methyl iodide. Other procedures may be programmed under the direction of the physicians and PET experts.

A.4 Carbon-11 Production System

Carbon-11 is formed by bombarding carbon-12 with $^{3}$He via the nuclear reaction $^{12}C(^{3}He, \alpha)^{11}C$. The carbon-11 target system and gas processing system are designed for the production of $^{11}C$ in the chemical forms $^{11}CO_2$, $^{11}CO$, $^{11}CH_3I$, and HCN. Using these simple precursors it is possible to label more complex organic and inorganic compounds. The estimated yields for these precursors are shown in Table A-1.

A.5 F-18 Production System

The fluorine-18 system utilizes $^{3}He$ bombardment of water. Other production techniques such as the bombardment of $O_2$ may be used as well. Bombardment of water provides $^{18}F$ as the fluoride anion via the nuclear reaction $^{16}O(^{3}He,p)^{18}F$. This method produces large yields of fluorine-18. The estimated yields for anhydrous $^{18}F$ and $^{18}F_2$ are shown in Table A-1.

A.6 Oxygen-15 Production System $^{15}O$ is produced by the $^{16}O(^{3}H,\alpha)^{15}O$ reaction in $O_2$ gas. The system is designed to produce $C^{15}O$, $^{15}O_2$, and $H_2{}^{15}O$ precursors. The estimated yields for these precursors are shown in Table A-1.

A.7 Nitrogen-13 Production System $^{13}N$-nitrogen is produced via the $^{12}C(^{3}He,pn)^{13}N$ nuclear reaction. The system is designed to produce the $^{13}N_2$ and $^{13}NH_3$ precursors. The estimated yields for these precursors are shown in Table A-1.

APPENDIX B

RFQ DESCRIPTION

A COMPACT 1-MeV DEUTERON RFQ LINAC*

Donald A. Swenson and Phillip E. Young
Science Applications International Corporation
Division 212, 2109 Air Park Rd. SE
Albuquerque, NM 87106

A compact 1-MeV deuteron radio frequency quadrupole (RFQ) linac has been designed and fabricated as part of an explosive detection system (EDS) for airport luggage surveillance. This system, based on the thermal neutron activation (TNA) technique, is capable of detecting high explosive materials in the midst of other materials with high probability. The role of the RFQ in this application is to accelerate deuterons for impact with a beryllium target, inside a neutron moderator, to produce intense bursts of thermal neutrons.

The thermal neutrons interact with a variety of nuclei in the luggage and produce characteristic high-energy gamma rays that are detected by an external array of detectors. The detector processing electronics converts the detected signals into pulses suitable for computer processing. If a predetermined set of conditions are fulfilled, such as a high count rate for nitrogen within certain spatial constraints, the system alarms to indicate the possible presence of an explosive threat.

The thermal neutron flux in the EDS should be high enough to satisfy a requirement for screening 6 or 7 luggage items per minute. Through extensive tests on EDS systems, developed by SAIC and tested at major airports, it has been determined that thermal neutron yields of $5 \times 10^9$ n/sec, in conjunction with suitable detectors and electronics, is needed for a production EDS.

Although tested extensively by SAIC, the neutron yield from commercially available 200 keV DD neutron sources are limited at about $1 \times 10^9$ n/sec. A significant increase in neutron yield is required for a production EDS.

A neutron source, based on a 1-MeV deuteron accelerator and a beryllium target, can easily produce the required neutron yield. The deuteron on beryllium (D-Be) reaction is favored over the D-D reaction from the point of view of neutron yield and energy spectra. Neutron transport calculations show that D-Be neutrons are more easily thermalized than D-D neutrons. The deuteron energy (1 MeV) and beam current (50 μA) are chosen to yield the desired neutron flux. Higher beam energy or current would increase neutron flux at the expense of an increased complexity of the system.

The commercial aspect of this application demands a compact, lightweight, low-power, reliable and inexpensive design. The RFQ linac, described in this report, meets all of these constraints. It was necessary to take some innovative steps, outside of the established RFQ parameter space, to arrive at this design. A list of the resulting parameters are given in Table I.

In the interest of compactness and reliability, the ion source, low energy beam transport (LEBT) system and RFQ linac are all housed in a single meter-long vacuum manifold. The entire system is evaluated by two turbomolecular pumps backed up by one roughing pump. No large aperture vacuum valves are employed. In order to achieve a lightweight design, most of the components are fabricated to aluminum, copper plated where necessary for conductivity.

TABLE I RFQ LINAC PARAMETERS

| | |
|---|---|
| Particle Type | Deuterons |
| Frequency, nominal | 425 MHz |
| Structure Length | 64 cm |
| Input Energy | 20 keV |
| Output Energy | 1 MeV |
| Input Current | 5.5 mA |
| Output Current | 5 mA |
| Pulse Length | 10 μs |
| Pulse Repetition Rate | 1 kHz |
| Pulse Duty Factor | 1% |
| Average Current | 50 μA |
| Radial Aperture | 0.15 cm |
| RF Drive Power, max | 52 kW |
| Input Emittance, (norm) | 0.005 cm-mrad |
| Output Emittance, (norm) | 0.005 cm-mrad |

RFQ Design Process

The RFQ design process, from the briefest description of the desired performance to the CNC milling machine instructions that put the delicate contours on the tips of the vanes, involves a series of interconnected computer-based design tools. In our case, these tools go by the names of RFQSCOPE, PARMTEQ, SUPERFISH, RFQVG, ME-10, and CAMp90.

RFQSCOPE helps the designer find the region of RFQ parameter space most likely to satisfy his design requirements. The process is fast and condusive to investigating large arrays of possible configurations. The designer is presented with arrays of numerical and graphical information describing the performance of specified configurations and data files to facilitate communication with more sophisticated beam dynamics programs.

PARMTEQ is the central tool for the design and analysis of RFQ structures. Starting from RFQSCOPE output files, it generates detailed descriptions of the RFQ geometry and its beam dynamical performance.

SUPERFISH provides the designer with information about the resonant frequency and electrical properties of the structure. With these data, he can select a transverse profile have the desired resonant frequency and can predict the rf power dissipation.

RFQVG, the RFQ vane geometry program, translates the RFQ geometry descriptions from PARMTEQ into detailed RFQ vane geometry descriptions. Practical consideration such as vane terminations and curve-fitting to facilitate machining are addressed. Data files from this program are transmitted by telephone from the SAIC VAX computer to the machinist's HP computer. There, these data are further massaged by his ME-10 and CAMp90 programs in preparation for machining the vane tips.

The array of parameters investigated for this design included injection energies in the range of 20 to 40 keV, beam apertures in the range of 0.15 to 0.20 cm, vane modulation factors in the range of 1.4 to 2.0, and peak vane-tip surface electric fields in the range of 1.6 to 1.8 Kilpatrick. An injection energy of 20 keV, a beam aperture of 0.15 cm, a vane modulation factor of 1.8 and a peak vane-tip surface electric field of 1.6 Kilpatrick were chosen as the most appropriate compromise between the desire for a low injection energy, a short cavity length, a low peak power, and an adequate space charge limit. The resulting design has length of only 64 cm, a calculated cavity power of only 28 kW, and a space-charge beam current limit of 28 mA.

The surface electric fields on the tip of the vanes for a perfect quadrupole field is $V/r_0$, where V is the peak vane-to-vane voltage and $r_0$ is the vane-tip radius. In an actual RFQ, the maximum surface fields are higher than this value by some field enhancement factor, K. This field enhancement factor is tabulated for a wide range of RFQ geometries Ref. The field enhancement factor for this design varies from 1.30 at the beginning of the structure to a maximum of 1.40 in the region of cells 40-60 before dropping to 1.34 at the output end. This RFQ design is based on $V/r_0$ field valve of 1.6 Kilpatrick, corresponding to a maximum surface field value of 1.4*1.6 = 2.24 Kilpatrick.

The beam dynamics, as evaluated by PARMTEQ, is shown in Fig 1, where the upper portion shows the transverse profile of the beam and the middle and lower portions show the phase and energy spreads of the beam as it passes through the structure.

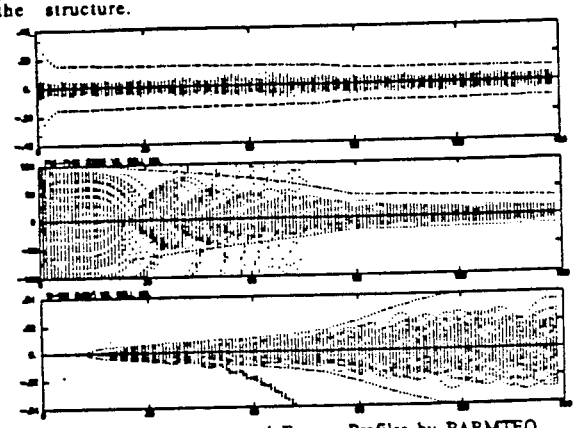

Fig. 1. X, Phase, and Energy Profiles by PARMTEQ.

The cross section of the cavity, as analyzed by SUPERFISH, is shown in Fig 2. It resonates at 425 MHz and has an inside diameter of 6.200 inches (15.748 cm), a radial aperture of only 1.5 mm, and constant vane-tip radius of 1.28 mm. The unusually small radial aperture had the advantage of reducing the rf power dissipation to an unprecedented low value. Although the small aperture is of some technical concern, it is worth noting that Los Alamos has recently chosen the same aperture for their next RFQ.

Mechanical Design, Fabrication, Assembly and Alignment

The mechanical design of the RFQ is based on the use of a heavy-walled aluminum tube (8"OD, 6"ID) as the main structural element of the assembly. After all welding on the assembly is completed, the assembly is stress relieved before final machining. The latter includes boring the inside of the cylinder to the precise diameter of 6.200 inches, and machining four precision flats on the outer surface of the cylinder. Extreme care is taken to insure that these flats are parallel to and equidistant from the axis of the interior surface, and parallel or perpendicular to each other.

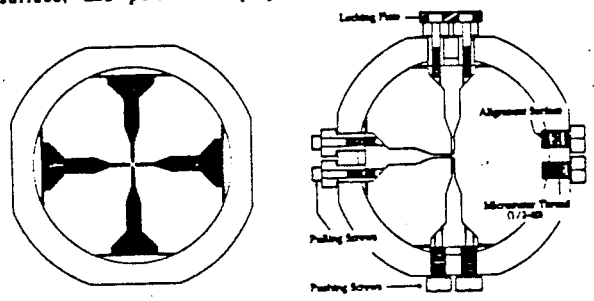

Fig. 2. RFQ Cross Section and Alignment Features.

The four RFQ vanes are mounted inside the heavy-walled aluminum tube (the vane housing) as shown in Fig 2. Electrical contact between the vanes and the vane housing is based on flexed fins at the base of the vanes, which are designed to produce a force of 100 pounds/inch, or greater against the vane housing. The range of fin flexure is designed to allow mechanical alignment of the vanes with a tolerable effect on this contact force.

Each vane is held in position by 6 pairs of concentric push/pull screw assemblies as shown in Fig 2. The pushing screws have a micrometer thread to the vane housing and form the vane-base alignment surfaces. The pulling screws serve to pull the vane bases against these alignment surfaces. The locking plates load the alignment screw threads to prevent accidental movement.

The RFQ vanes are designed in the conventional manner with the vane tips extending close to the end plates of the RFQ cavity with a cutout between the vane tips and the vane bases to allow the rf magnetic fields to wrap around the ends of the vanes. A sketch of the vane termination is shown in Fig 3. The gap between the vane tip and the end plate is 0.500 cm. The cutout has an area of about 13.2 $cm^2$. The vane base makes electrical contact with the end plate through a segment of spring ring in a groove in the end of vane base.

The vanes are fabricated from the aluminum alloy 7075, which has the best spring properties for the flexed fins. The vane material is purchased as rectangular bars with gun-drilled cooling channels through their long dimensions. The bars, bolted to a rigid machining fixture, are machined to the desired cross section by conventional CNC milling machines. At this stage, the vane tip is still in the form of a rectangular blade 0.256 cm thick. The ends of the vanes are cut off and contoured by a computer-controlled wire electrical discharge machining (EDM) process. The last step in the machining of the vanes is to put the delicate contours on the vane tips.

The longitudinal vane-tip profile, evaluated by RFQVG, involves a numerical solution of the idealized RFQ potential function. Tables of such results are not the most convenient form of communication with the vane-tip machining process. Computer Aided Machining (CAM) processes translate most cutting processes into straight line segments and circular arcs. The standard vane-tip profile between a peak and an adjacent valley was translated into three segments, namely a circular arc, a straight line, and a circular arc, in such a way as to preserve the height and location of the peak, the depth and location of the valley, the slope at the midpoint between the peak and valley, and a smooth interface between all segments.

At the input end of the RFQ, the radial matching section is blended smoothly into the radial cut forming the end of the vane tip. At the output end of the RFQ, a circular arc, of one-centimeter radius, is appended to each vane, blending smoothly with the radial cut forming the end of the vane tip.

The constant vane-tip-radius design allows the use of a special shaped cutter for contouring the vane tips, which greatly reduces the cost of the vane-tip machining. RFQ designers are well aware of a constraint on the radius of this

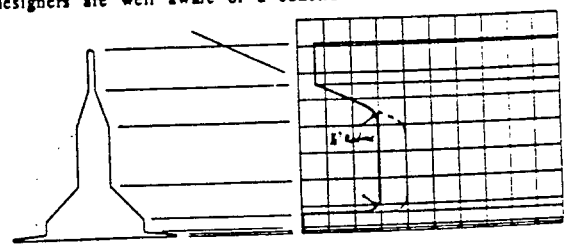

Fig. 3. Vane Cross Section and End Profile.

cutter coming from the geometrical details of the vane-tip profile itself. The constraint is simply that the tool radius must be smaller than the minimum concaved radius of the vane-tip profile.

This design, involving acceleration of deuterons at 425 MHz from an injection energy of 20 keV, represents the smallest concaved vane profile radii in the history of RFQ fabrication. The minimum concaved radius of this design is 2.883 mm. A cutting tool was designed with a radius of 2.794 mm. The tool has the form of a single flute cutter in a cylindrical holder. Both the tool and the holder were fabricated by the EDM process. This tool was tested and the results were satisfactory. Subsequently, a cutting tool with a radius of 2.54 mm was fabricated and used for the actual vane-tip machining.

The vane-tip machining process took only one hour per vane, including mounting the vane on the machining fixture, checking the alignment, making two preliminary passes and one final pass at the contour, and removing the vane from the fixture. Five vane-tips (including one on a spare vane) were processed in one afternoon. The same cutter was used for the entire process.

The interior surface of the vane housing and the majority of the vane surfaces are copper plated (UBAC-R1 process) for electrical conductivity. The vane tips are left unplated as a precaution against possible problems with copper plating in the region of high field and critical geometry. The exterior of the vane housing and flanges are anodized black to provide a smooth stable surface for precision alignment measurements.

After all the parts were readied, the installation and preliminary alignment of the four vanes took only four hours. Precision alignment of the four vanes took another four hours.

The installation process starts with the installation of the 48 micrometer-thread pushing screws that form the alignment surfaces and the 24 locking plates that restrict their motion. The pushing screws are initially set to their nominal position relative to the flats on the exterior surface of the vane housing. The vanes are installed to their nominal positions, one at a time, in any order. They may be aligned as they are installed or the alignment may be postponed until several or all have been installed. After the vanes are installed, the position of the vanes are adjusted by moving the pushing and pulling screws to achieve the desired gap spacing. The counteracting forces from the pushing and pulling screws keeps the vane position under positive control and contributes to the alignment accuracy achievable from this design.

All of the measurements required to align a vane, or check its alignment can be made at any time without regard to the status of the other vanes. The primary reference for all alignment measurements are the four flat surfaces accurately machined on the outer surface of the vane housing. The vane alignment is based on depth-micrometer measurements from these flats through holes in the housing and the vanes, to selected flat portions of the vanes.

Although test results do not indicate the need, field stabilization techniques could also be employed in this design at a later time to stabilize the quadrupole fields. Many techniques are available to stabilize the fields, including resonant end tuners, resonant azimuthal tuners and resonant longitudinal tuners. Vane coupling rings of the Lawrence Berkeley Laboratory design could also be added, but at the cost of increased structural complexity.

The cooling of the RFQ structure is accomplished by running a circuit of water through each vane and along the outside of each quadrant of the vane housing. The temperature of the structure is controlled to 1° C.

The vacuum requirement is enormously simplified by surrounding the entire RFQ assembly with a simple vacuum manifold, thereby eliminating hundreds of vacuum seals that would otherwise be required. The pressure in the RFQ end of the vacuum enclosure will be held to $1 \times 10^{-6}$ Torr or better.

Low Power RF Measurement Results

The following low-power rf measurements were made on the completed RFQ structure: the resonant frequency of the quadrupole mode, the resonant frequency of the nearest dipole modes, the electrical quality factor (Q) of the structure, and the rf field distribution in quadrupole mode.

The resonant frequency of the quadrupole mode was measured to be 426.59 MHz. Although there is no necessity to do so, this could easily be tuned to design value of 425.0 MHz.

The nearest dipole mode is at 422.79 MHz. This is far enough from the quadrupole mode (3.8 MHz) to preclude problems of mode mixing which can shift distribution of field energy.

The electrical Q was determined to be 6108, which is 61% of the theoretical value. This excellent performance, by RFQ standards, can be attributed to the small number of electrical contacts (two per vane) through which the quadrupole mode currents flow in this design.

The field distribution in the quadrupole mode was measured by the "plunger" perturbation technique. In this technique, certain resonant properties of the quadrupole mode were monitored with great accuracy while a metallic plunger was inserted a fixed distance into each of 10 half-inch-diameter holes in each of the four quadrants.

The data so obtained indicates a small end-cell tuning error and a small vane alignment error. These errors are readily correctable by a minor change in the end cell tuning and a small adjustment in the position of the vanes relative to each other. The uniformity of these data for the cavity, as aligned mechanically, is excellent by RFQ standards and speaks well for the cavity design and alignment procedure.

Completion of the Linac System

The first phase of funding for this project covered the design of all the components of the system, but limited the fabrication to the linac structure itself. Contributing to the compactness of the entire system are several innovative features of the ion source, low energy transport system (LEBT), and rf power systems.

The ion source will be a commercial duoplasmatron unit, operated on deuterium gas and modified to mount inside the cover plate of the vacuum housing. Advantages can be taken of the low operating voltage (20 kV) and the vacuum environment to reduce the size of the insulating structure.

The LEBT will employ an RFQ lens in a new and innovative way that results in a substantial increase in lens strength and a very compact interface between the ion source and the RFQ linac.

The rf power will be supplied by close-coupled Eimac planar triodes, mounted inside the vacuum housing directly on the vane housing and operated in a grounded grid fashion. Services to this power system are reduced to 8 kV anode power, tube heater power, 6 kW of rf drive power, and cooling water.

The resulting package is extremely compact, as required by this commercial application, with the ion source, LEBT, RFQ, and power amplifiers of the rf system all located inside the 0.3-m-diameter by 1-m-long vacuum housing. More information on these auxiliary components will be published on completion of the system.

What is claimed is:

1. A system for producing radionuclides for use with positron emission tomography (PET), said system comprising:

a source of ions for producing a $^3He^{++}$ beam at a low energy;

radio frequency quadrupole (RFQ) accelerator means for accelerating said $^3He^{++}$ beam to an energy level of about 8 MeV; and a target system having a selected target compound therein irradiated with said accelerated $^3He^{++}$ beam to produce at least one radionuclide having application to PET.

2. The system of claim 1 wherein said desired radionuclide belongs to the group comprising $^{13}F$, $^{13}N$, $^{15}O$, and $^{11}C$.

3. The system of claim 1 wherein said ion source, beam transport means, RFQ accelerator, and target system collectively weigh no more than one ton.

4. The system of claim 1 wherein said ion source, beam transport means, RFQ accelerator, and target system are mounted for operation within a movable compartment, such as a trailer, whereby said entire system is transportable.

5. The system of claim 1 further including:

low energy beam transport means for coupling the $^3He^{++}$ beam from said source of ions to said RFQ accelerator; and high energy transport means for directing the accelerated $^3He^{++}$ beam from said RFQ accelerator to said target system.

6. The system of claim 5 further including beam dump means selectively coupled to said high energy transport means, whereby the accelerated $^3He^{++}$ beam can be selectively dumped away from said target system.

7. The system of claim 1 further including cooling means for removing heat from said source of ions and said RFQ accelerator.

8. The system of claim 7 wherein said cooling means maintains the temperature of said RFQ accelerator to within one degree Centigrade of a specified operating temperature.

9. The system of claim 1 further including vacuum means coupled to said RFQ accelerator means for maintaining a vacuum around said RFQ of up to $10^{-6}$ Torr.

10. The system of claim 1 further including operator means for controlling the operation of said system, said operator means providing a push-button operator interface that selects one of three operating states for the system: a standby state, a ready state, and a run state.

11. The system of claim 1 wherein said target system comprises a windowless target system, said windowless target system including a long, narrow tube connecting the high energy end of said RFQ accelerator means to said selected target compound and a vacuum system means for continuously pumping said tube with a vacuum pump.

12. The system of claim 11 wherein said windowless target system further includes pulsed aperture means near the target end of said tube for opening and closing said tube in phase with the delivery of said high energy beam from said RFQ accelerator means.

13. A method for producing a radiopharmaceutical suitable for use with a positron emission tomography (PET) system, said method comprising the steps of:

(a) accelerating a beam of $^3He^{++}$ ions with a RFQ accelerator to a energy level of about 8 MeV;

(b) irradiating a target compound with the accelerated $^3He^{++}$ beam to produce at least one radionuclide having application to PET;

(c) processing the radionuclide obtained in step (b) to produce a desired precursor containing said radionuclide; and (d) preparing a suitable radiopharmaceutical containing said precursor.

14. The method of claim 13 wherein step (a) comprises:

activating a source of $^3He^{++}$ ions to produce a low energy beam of $^3He^{++}$ ions;

transporting said low energy beam of $^3He^{++}$ ions to a radio frequency quadrupole (RFQ) accelerator; and accelerating said low energy beam in said RFQ accelerator to said energy level of about 8 MeV.

* * * * *

UNITED STATES PATENT AND TRADEMARK OFFICE

CERTIFICATE OF CORRECTION

PATENT NO. : 5,037,602

DATED : August 6, 1991

INVENTOR(S) : Ali E. Dabiri et al.

It is certified that error appears in the above-identified patent and that said Letters Patent is hereby corrected as shown below:

On the title page item [56]:

Under the "Blue" reference, change the patent number from "4,888,532" to --4,088,532--.

Signed and Sealed this

Nineteenth Day of January, 1993

*Attest:*

DOUGLAS B. COMER

*Attesting Officer*

*Acting Commissioner of Patents and Trademarks*